US011213935B2

(12) United States Patent
MacDonald

(10) Patent No.: US 11,213,935 B2
(45) Date of Patent: Jan. 4, 2022

(54) RATCHETING WRENCH SYSTEM HAVING A LINEAR TWO-PAWL RATCHET MECHANISM CAPABLE OF EXCHANGEABLE WRENCH HEADS

(71) Applicant: Jeffrey Dean MacDonald, Victoria (CA)

(72) Inventor: Jeffrey Dean MacDonald, Victoria (CA)

( * ) Notice: Subject to any disclaimer, the term of this patent is extended or adjusted under 35 U.S.C. 154(b) by 550 days.

(21) Appl. No.: 16/091,983

(22) PCT Filed: Mar. 27, 2017

(86) PCT No.: PCT/CA2017/050380
§ 371 (c)(1),
(2) Date: Oct. 6, 2018

(87) PCT Pub. No.: WO2017/173529
PCT Pub. Date: Oct. 12, 2017

(65) Prior Publication Data

US 2019/0118354 A1 Apr. 25, 2019

(30) Foreign Application Priority Data

Apr. 6, 2016 (CA) ..... CA 2926002

(51) Int. Cl.
*B25B 23/00* (2006.01)
*B25B 13/46* (2006.01)
*B25B 13/58* (2006.01)

(52) U.S. Cl.
CPC ..... *B25B 23/0035* (2013.01); *B25B 13/463* (2013.01); *B25B 13/58* (2013.01)

(58) Field of Classification Search
None
See application file for complete search history.

(56) References Cited

U.S. PATENT DOCUMENTS

| | | | | |
|---|---|---|---|---|
| 732,055 | A * | 6/1903 | Donavan | B25B 13/463 81/58.2 |
| 2,193,984 | A * | 3/1940 | Harry | B25B 13/463 192/43.2 |
| 5,501,124 | A * | 3/1996 | Ashby | B25B 13/08 81/58.2 |
| 7,600,451 | B2 * | 10/2009 | Lechot | A61B 17/1624 81/60 |
| 10,406,658 | B2 * | 9/2019 | MacDonald | B25B 13/463 |

* cited by examiner

*Primary Examiner* — Hadi Shakeri
(74) *Attorney, Agent, or Firm* — Law Office of Michael Antone; Michael Antone

(57) ABSTRACT

Disclosed herein is a ratchetable wrench, with, in some embodiments the ability to interchange wrench heads for working with various styles of rotatable fittings. The disclosed ratchetable wrench includes a two-pawl ratchet mechanism for use with an open-ended wrench head. The two-pawl mechanism allows the wrench head to be freely rotatable relative the wrench body when the pawls are in a user-selected tooth-disengaged position such that the pawls are disengaged from teeth located about the periphery of an installed cogged wrench head and rotatable only in one direction relative the wrench body when the pawls are in a tooth-engaged position. A plurality of interchangeable wrench heads for use with an embodiment of the ratchetable wrench and a method of the interchanging various wrench heads are also disclosed herein.

20 Claims, 16 Drawing Sheets

RATCHETING WRENCH SYSTEM HAVING A LINEAR TWO-PAWL RATCHET MECHANISM CAPABLE OF EXCHANGEABLE WRENCH HEADS

CROSS-REFERENCE TO RELATED APPLICATIONS

The present application claims the benefit of and priority to PCT Patent Application No. PCTCA2017050380 filed Mar. 27, 2017, which claims the benefit of and priority to Canadian Patent Application serial number 2,962,002 entitled "RATCHETING WRENCH SYSTEM HAVING A LINEAR TWO-PAWL RATCHET MECHANISM CAPABLE OF EXCHANGEABLE WRENCH HEADS", filed Apr. 6, 2016, both of which are herein incorporated by reference in their entireties.

STATEMENT REGARDING FEDERALLY SPONSORED RESEARCH OR DEVELOPMENT

Not Applicable

BACKGROUND OF THE INVENTION

Field of the Invention

The present disclosure relates to a ratchet wrench with interchangeable wrench heads. More particularly the present disclosure relates to a ratchet wrench which is capable of mating with and ratcheting at least one ratchetable open-ended wrench head.

Background

Ratchet wrenches have mechanisms which allows such a wrench to transmit torque in one direction to a fitting such as a nut or bolt, yet allows free rotation of the handle while the wrench head remains in communication with the nut or bolt. Although ratchet wrenches are known in the art, they are also known to have certain drawbacks. For example, socket-style wrench heads for use with ratchetable socket wrench handles are known which are capable of rotatably tightening or loosening fittings such as nuts and bolt heads. The socket wrench heads of this type of wrench are often interchangeable such that a variety of different socket wrench heads can be used with the same ratchetable socket wrench body. Such socket-type ratchet wrenches, however, cannot be used as a line wrench since the socket can only fit over a fitting and thus cannot be used to tighten or loosen a fitting such as that to connect hydraulic lines where a line or other part of a fitting must pass through the wrench head. Furthermore, conventional socket-style ratchet wrenches may not fit to be used in certain areas or are very cumbersome to use in a given provided space. Box-end ratchet wrenches are also known, however, such types of ratchet wrenches generally do not have interchangeable wrench heads and like the abovementioned socket-style, can only fit over a fitting such as a nut or bolt head.

Therefore, in certain applications, such as in the case of tightening or loosening a hydraulic line, an open-end wrench must be used. However, generally, open-ended wrenches are not ratchetable and the wrench head is thus fixed relative to the wrench handle. One of the drawbacks of this fixed relationship of the wrench handle and the wrench head is that in tight areas, in order to rotate a fitting, the wrench handle must be rotated, but is limited in the degree of rotation to the available space. The wrench head must be disengaged from the fitting and repositioned. This is a time consuming process. Furthermore, in some limited space areas the degree of allowable handle rotational angle does not cleanly correspond to the perimeter facets of the fitting which the wrench head engages and thus not all of the allowable handle rotational angle can be utilized to rotate the fitting. This leads to an increase in the number of times that the wrench head must be disengaged and refitted to the fitting in order to complete a required rotation. In such cases a ratchetable wrench head is desirable since the wrench head does not have to be disengaged and refitted to the fitting as with a fixed wrench head. Additionally, the ratchet mechanism (spacing between ratchet teeth) may provide smaller rotation angle increments so as to compensate for the relative perimeter facet angles of the fitting thus leading to less strokes required to rotate the fitting to the desired amount.

U.S. Pat. No. 2,636,411, issued Apr. 28, 1953 to Wood and entitled "OPEN END RATCHET WRENCH", discloses an open-ended ratchet wrench were the socket is held in place by a pair of gripping jaws. The ratchet action is provided by a plurality of teeth located about the periphery of the socket interacting with a pair of pins located in recesses on opposite sides of the wrench head. The pins cannot be withdrawn to allow free rotation of the socket relative to the wrench handle.

U.S. Pat. No. 2,660,910, issued Dec. 1, 1953 to Sellers and entitled "RATCHET WRENCH", discloses an open-ended ratchet wrench were the socket is held in place by semi-circular flanges formed integrally with the wrench body and an arcuate cover plate. The ratchet action is provided by a single actuating member biased in the direction of the socket having a plurality of teeth. The teeth of the single actuating member interact with the teeth located on the periphery of the jaw member or socket. Rotation of a handle element located on the handle and connected to two cam portions effects user-selective withdrawal of the single actuating member teeth from the jaw member teeth such that the wrench body and the jaws may freely rotate relative to one another.

International Patent Application No. PCT/CA2013/000423, published Nov. 7, 2013 to MacDonald and entitled "OPEN-ENDED RATCHET WRENCH", now U.S. Pat. No. 10,406,658, discloses an open-ended ratchet wrench where the socket or jaws is held in place in a wrench head receiving region by a pair of arcuate flanges integrally formed within the wrench body and cover plate. There are a pair of pawls arranged in a "V"-shape confirmation such that when distal end regions of the pawls are engaged with teeth located about the periphery of the jaws, the jaws are permitted to rotate only in the direction of one of the pawls and not the other, thus enabling the ratcheting wrench action. The pawls may be spread apart by a pawl control interacting with the pawl or pawl protrusions located on the pawls such that the pawls pivotally rotate about an end region proximal to the wrench handle and open relative one another at the distal end regions so as to disengage with the teeth and thus allow the jaws to rotate freely in either direction relative the wrench handle.

This background information is provided to reveal information believed by the applicant to be of possible relevance. No admission is necessarily intended, nor should be construed, that any of the preceding information constitutes prior art.

BRIEF SUMMARY OF THE INVENTION

In light of the above, it would be desirable to provide a ratchetable wrench with interchangeable wrench heads wherein the wrench can be fitted with open-ended wrench heads, among other types of wrench heads, for rotating fittings that can only be rotated with an open-ended wrench head. For example, it would be desirable to provide an open-ended ratchet wrench where the wrench head may rotate freely to be aligned with the perimeter facets of a fitting and be impeded from rotational movement relative to a wrench handle in at least one direction for rotating the fitting. Such an open-end ratchet wrench could be easily installed on and off rotatable fittings such as those found on hydraulic lines or other places were a line wrench must be used.

It would also be desirable to have such a single ratchetable wrench be able to work with a variety of wrench heads such as an above-indicated line wrench sprocket head, a line wrench socket head, an open-sided sprocket wrench head, an open-sided socket wrench head, a box-ended sprocket wrench head, a box-ended socket wrench head, a pass-through socket wrench head, a driver-bit wrench head, a screwdriver wrench head and/or a universal socket adapter wrench head as well as various sizes of said wrench heads for correspondingly mating with various fitting sizes. Therefore, wrench heads may be easily replaced by one of another style for use with different fittings. Such a ratchetable wrench system may thus provide a wrench system having less weight and requiring less storage space than a fixed wrench head wrench set capable of interacting with the same number of fitting types.

The following presents a simplified summary of the general inventive concepts described herein to provide a basic understanding of some aspects of the invention. This summary is not an extensive overview of the invention. It is not intended to restrict key or critical elements of the invention or to delineate the scope of the invention beyond that which is explicitly or implicitly described by the following description and claims.

In one aspect there is provided a ratchet assembly for use with rotatable fittings. The ratchet assembly has at least a handle portion and an opposed fitting engaging region defining a wrench body. The fitting engaging region has a wrench body arcuate mating feature for receiving in operable rotatable communication a head arcuate mating feature of a fitting engageable wrench head where wrench body and the wrench head are rotatable relative to one another about an axis of rotation with the head arcuate mating feature and the body arcuate mating feature in communication. The wrench head includes a plurality of uniformly spaced-apart teeth located about the periphery thereof for engaging with a distal end region of at least a first pawl having a tooth-engaging hooking distal end region and/or a second pawl having a tooth-engaging abutting distal end region. The first and second pawls each respectively received in a first pawl receiving channel and a second pawl receiving channel disposed in the wrench body and each sized to allow independent linear movement in one axis of the first and second pawls against a reversible linear tooth-engaging ratcheting resilient bias in a first pawl disengager orientation and a user-selective reversible linear disengagement from the teeth of the tooth-engaging hooking distal end region and the tooth-engaging abutting distal end region in a second pawl disengager orientation. The first and second pawl receiving channels are joined by a pawl disengager region disposed in the wrench body and the pawl disengager region has a rotatable pawl disengager disposed therein for effecting the user-selective linear disengagement. The periphery of the rotatable pawl disengager is shaped for communication with a first pawl disengager effector region located between the first pawl distal end region and a first pawl proximal end region and communication with an angled second pawl disengager effector region located near a second pawl proximal end region to effect the user-selective disengagement of the tooth-engaging hooking distal end region and the tooth-engaging abutting distal end region when the pawl disengager is in said second pawl disengager orientation. When the rotatable pawl disengager is in the first pawl disengager orientation, the wrench body may only rotate relative said wrench head in a direction towards said first pawl.

In another aspect, an interchangeable wrench head ratchet assembly system for use with rotatable fittings comprising one or more different fitting engageable interchangeable wrench heads and a ratchet assembly having at least a handle portion and an opposed fitting engaging region defining a wrench body is provided. The fitting engaging region has a wrench body arcuate mating feature for receiving in operable rotatable communication a head arcuate mating feature of the one or more fitting engageable interchangeable wrench heads where the wrench body and the one or more fitting engageable interchangeable wrench heads is rotatable relative to one another about an axis of rotation with the head arcuate mating feature and the body arcuate mating feature in communication. The fitting engaging region includes a removable wrench head retaining cover reversibly couplable to the wrench body for permitting installation, removal and selectively maintaining said one or more interchangeable wrench heads in said fitting engaging region. The wrench head has a plurality of uniformly spaced-apart teeth located about the periphery thereof for engaging with a distal end region of at least a first pawl having a tooth-engaging hooking distal end region and/or a second pawl having a tooth-engaging abutting distal end region. The first and second pawls each are respectively received in a first pawl receiving channel and a second pawl receiving channel disposed in said wrench body and each sized to allow independent linear movement in one axis of said first and second pawls against a reversible linear tooth-engaging ratcheting resilient bias in a first pawl disengager orientation and a user-selective reversible linear disengagement from the teeth of said tooth-engaging hooking distal end region and the tooth-engaging abutting distal end region in a second pawl disengager orientation. The first and second pawl receiving channels are joined by a pawl disengager region disposed in the wrench body where the pawl disengager region has a rotatable pawl disengager disposed therein for effecting the user-selective linear disengagement. The periphery of the rotatable pawl disengager is shaped for communication with a first pawl disengager effector region located between the first pawl distal end region and a first pawl proximal end region and communication with an angled second pawl disengager effector region located near a second pawl proximal end region to effect the user-selective disengagement of the tooth-engaging hooking distal end region and the tooth-engaging abutting distal end region when the pawl disengager is in the second pawl disengager orientation. When the rotatable pawl disengager is in the first pawl disengager orientation, the wrench body may only be rotatable relative to the wrench head in a direction towards said first pawl.

In yet another aspect, the present disclosure provides an interchangeable wrench head ratchet for receiving an interchangeable wrench head and for use with rotatable fittings comprising a ratchet assembly having at least a handle portion and an opposed fitting engaging region defining a wrench body. The fitting engaging region has a wrench body arcuate mating feature for receiving in operable rotatable communication a head arcuate mating feature of one or more perimeter-toothed fitting engageable interchangeable wrench heads. The wrench body and the wrench head are rotatable relative to one another about an axis of rotation with the head arcuate mating feature and the body arcuate mating feature in communication. The fitting engaging region includes a removable wrench head retaining cover reversibly couplable to the wrench body for permitting installation, removal and selectively maintaining said one or more fitting engageable interchangeable wrench heads in the fitting engaging region. A first pawl having a tooth-engaging hooking distal end region and a second pawl having a tooth-engaging abutting distal end region each being respectively received in a first pawl receiving channel and a second pawl receiving channel disposed in the wrench body are provided. Each of the first and second pawl receiving channels are sized to allow independent linear movement in one axis of the first and second pawls against a reversible linear tooth-engaging ratcheting resilient bias in a first pawl disengager orientation and a user-selective reversible linear disengagement of said tooth-engaging hooking distal end region and said tooth-engaging abutting distal end region from said teeth in a second pawl disengager orientation. The first and second pawl receiving channels are joined by a pawl disengager region disposed in the wrench body and the pawl disengager region has a rotatable pawl disengager disposed therein for effecting said user-selective linear disengagement. The periphery of the rotatable pawl disengager is shaped for communication with a first pawl disengager effector region located between the first pawl distal end region and a first pawl proximal end region and communication with an angled second pawl disengager effector region located near a second pawl proximal end region to effect said user-selective disengagement of said tooth-engaging hooking distal end region and said tooth-engaging abutting distal end region when the pawl disengager is in said second pawl disengager orientation and when the rotatable pawl disengager is in the first pawl disengager orientation the wrench body may only be rotatable relative the wrench head in a direction towards said first pawl.

In still yet another aspect, there is provided an interchangeable ratchet wrench head for use with the interchangeable wrench head ratchet as disclosed herein. The interchangeable ratchet wrench head has a plurality of uniformly spaced-apart teeth located about the periphery thereof for engaging with the distal end region of at least the first pawl which has the tooth-engaging hooking distal end region and/or the second pawl which has the tooth-engaging abutting distal end region. Furthermore, in some embodiments, the head arcuate mating feature comprises an arcuate ridge and the wrench body arcuate mating feature comprises a corresponding arcuate channel.

In some exemplary embodiments, the tooth-engaging hooking distal end region resilient biasing is in the direction of the fitting engaging region and the tooth-engaging abutting distal end region resilient biasing is tangential to the body arcuate mating feature. Additionally, for example, in some embodiments the resilient biasing of the first pawl is provided by a first spring located in a proximal end region of the first pawl receiving channel and the resilient biasing of the second pawl is provided by a second spring located in a distal end region of the second pawl receiving channel.

In some preferred exemplary embodiments, when the rotatable pawl disengager is in the second pawl disengager position, the wrench head may be rotatable relative to the wrench in either direction. Furthermore, in some preferred exemplary embodiments, the rotatable pawl disengager has an elliptical perimeter shape with first and second directrices, where the first pawl disengager effector region is provided as a corresponding concave depression for reversibly communicating with the first directrix and the angled second pawl disengager effector region is provided for reversibly communicating with the second directrix.

In some exemplary embodiments, manual rotation of the rotatable pawl disengager from the first pawl disengager orientation to the second pawl disengager orientation causes said first directrix to interact with the first pawl disengager effector region and the second directrix to interact with the angled second pawl disengager effector region so as to move the first and second pawls within the first and second channels against the resilient biases to user-selectively disengage the tooth-engaging hooking distal end region and the tooth-engaging abutting distal end region from the teeth. Additionally, in some exemplary embodiments, there is provided an external rotatable pawl disengager lever operably coupled to the rotatable pawl disengager for effecting the user-selective rotation of the rotatable pawl disengager between the first and second pawl disengager orientations.

In some exemplary embodiments, the ratchet assembly further comprises a pawl mechanism cover plate for enclosing and substantially sealing the first and second pawls respectively in the first and second pawl receiving channels and the rotatable pawl disengager in the wrench body.

In some exemplary embodiments, there is further provided a removable wrench head retaining cover reversibly couplable to the wrench body for permitting installation, removal and selectively maintaining said one or more interchangeable wrench heads in said fitting engaging region. In such embodiments, the removable wrench head retaining cover may include at least one tab for reversibly mating with a corresponding first tab receiving region located on a peripheral area of the fitting engaging region and a proximal holding clip mating region for reversibly mating with a wrench head retaining cover holding clip moveable along a region of said handle portion of the wrench body for maintaining said wrench head retaining cover in operable communication with said wrench body. Furthermore, in some exemplary embodiments, the wrench head retaining cover holding clip may be resiliently biased toward said fitting engaging region.

In various exemplary embodiments, the one or more interchangeable wrench head may be a line wrench sprocket wrench head, a line wrench socket wrench head, an open-sided sprocket wrench head, an open-sided socket wrench head, a box-end sprocket wrench head, a pass-through socket wrench head, a driver-bit wrench head, a screwdriver wrench head or a universal socket adapter wrench head.

In another aspect, further to the abovementioned ratchet assembly, system and disclosed interchangeable wrench head for use therewith, a method for interchanging one or more fitting engageable interchangeable wrench heads for use with rotatable fittings with a corresponding interchangeable wrench head ratchet wrench is provided. The method comprises: providing the interchangeable wrench head ratchet wrench having a fitting engaging region with a wrench body arcuate mating feature for receiving in operable rotatable communication a head arcuate mating feature of the one or more fitting engageable interchangeable wrench heads; removing a removable wrench head retaining cover reversibly couplable to the wrench body over a portion of the fitting engaging region so as to expose said fitting engaging region; and removing said fitting engageable interchangeable wrench head from said fitting engaging region.

In some embodiments prior to removing said removable wrench head retaining cover, the method further comprises rotating an elliptically-shaped pawl disengager disposed in a wrench body from a first pawl disengager orientation to a second pawl disengager orientation wherein a first directrix of the elliptically-shaped pawl disengager communicates with a first pawl disengager effector region located between a first pawl distal end region and a first pawl proximal end region of a first pawl having a tooth-engaging hooking distal end region and a second directrix of the elliptically-shaped pawl disengager communicates with an angled second pawl disengager effector region located near a second pawl proximal end region of a second pawl having a tooth-engaging abutting distal end region to effect linear movement against a resilient bias of the first and second pawls in respective first and second pawl receiving channels of said wrench body and disengage the tooth-engaging hooking distal end region and tooth-engaging abutting distal end region from teeth located about the periphery of the fitting engageable interchangeable wrench head such that the fitting engageable interchangeable wrench head is permitted to rotate in either direction guided by the correspondingly mated head and wrench body arcuate mating features.

In some embodiments, the method further comprising: installing a different one of the one or more interchangeable wrench heads in the fitting engaging region; reinstalling the removable wrench head retaining cover on the wrench body.

In some embodiments, the method further comprising: installing a different one of the one or more interchangeable wrench heads in the fitting engaging region; reinstalling the removable wrench head retaining cover on the wrench body; and rotating the elliptically-shaped pawl disengager from the second pawl disengager orientation to the first pawl disengager orientation so as to effect linear movement of the first and second pawls in respective the first and second pawl receiving channels to engage the tooth-engaging hooking distal end region and the tooth-engaging abutting distal end region each with one of the teeth of said fitting engageable interchangeable wrench head such that the fitting engageable interchangeable wrench head is permitted to rotate relative the wrench head only in a direction towards the first pawl and the rotation guided by the correspondingly mated head and wrench body arcuate mating features.

In some embodiments, the method further comprises the abovementioned external rotatable pawl disengager lever operably coupled to the rotatable pawl disengager, wherein the lever is rotated to effect rotation of the rotatable pawl disengager between the first and second pawl disengager orientations.

The preferred exemplarity embodiments, the one or more fitting engageable interchangeable wrench heads is a line wrench sprocket wrench head, a line wrench socket wrench head, an open-sided sprocket wrench head, an open-sided socket wrench head, a box-end sprocket wrench head, a pass-through socket wrench head, a driver-bit wrench head, a screwdriver wrench head or a universal socket adapter wrench head.

Other aims, objects, advantages and features of the invention will become more apparent upon reading of the following non-restrictive description of specific embodiments thereof, given by way of example only with reference to the accompanying drawings.

BRIEF DESCRIPTION OF THE DRAWINGS

In order that the invention may be better understood, exemplary embodiments will now be described by way of example only, with references to the accompanying drawings, wherein.

DETAILED DESCRIPTION OF THE INVENTION

With reference to the disclosure herein and the appended figures, a ratchet assembly 10 for use with rotatable fittings and non-removable wrench heads 26 or interchangeable wrench heads 82 for use therewith in accordance with various embodiments of the invention is provided.

Figure 1:
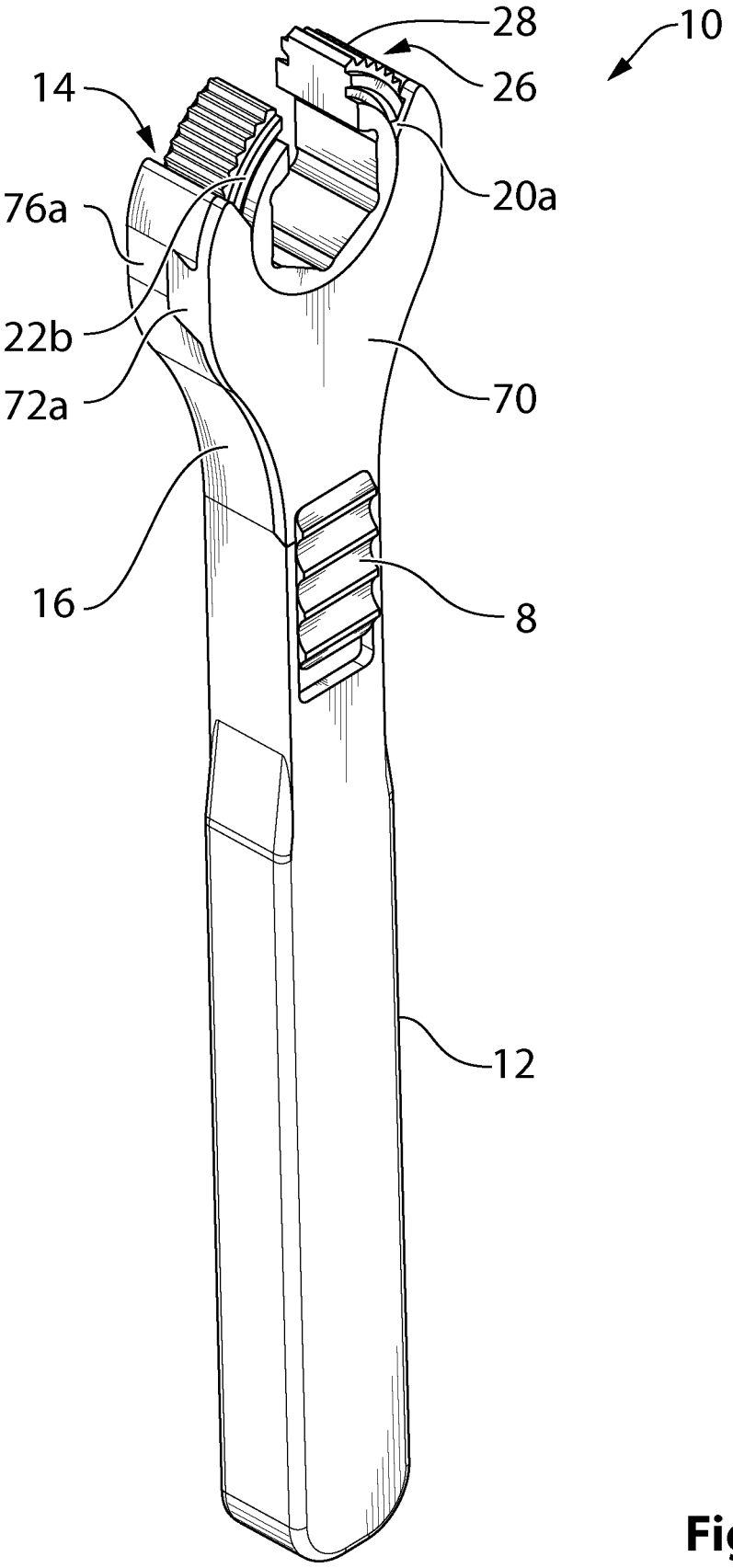
FIG. 1 is a perspective view of an embodiment of an exemplary interchangeable wrench head ratchet assembly with a fitting engageable wrench head installed.
Figure 2:
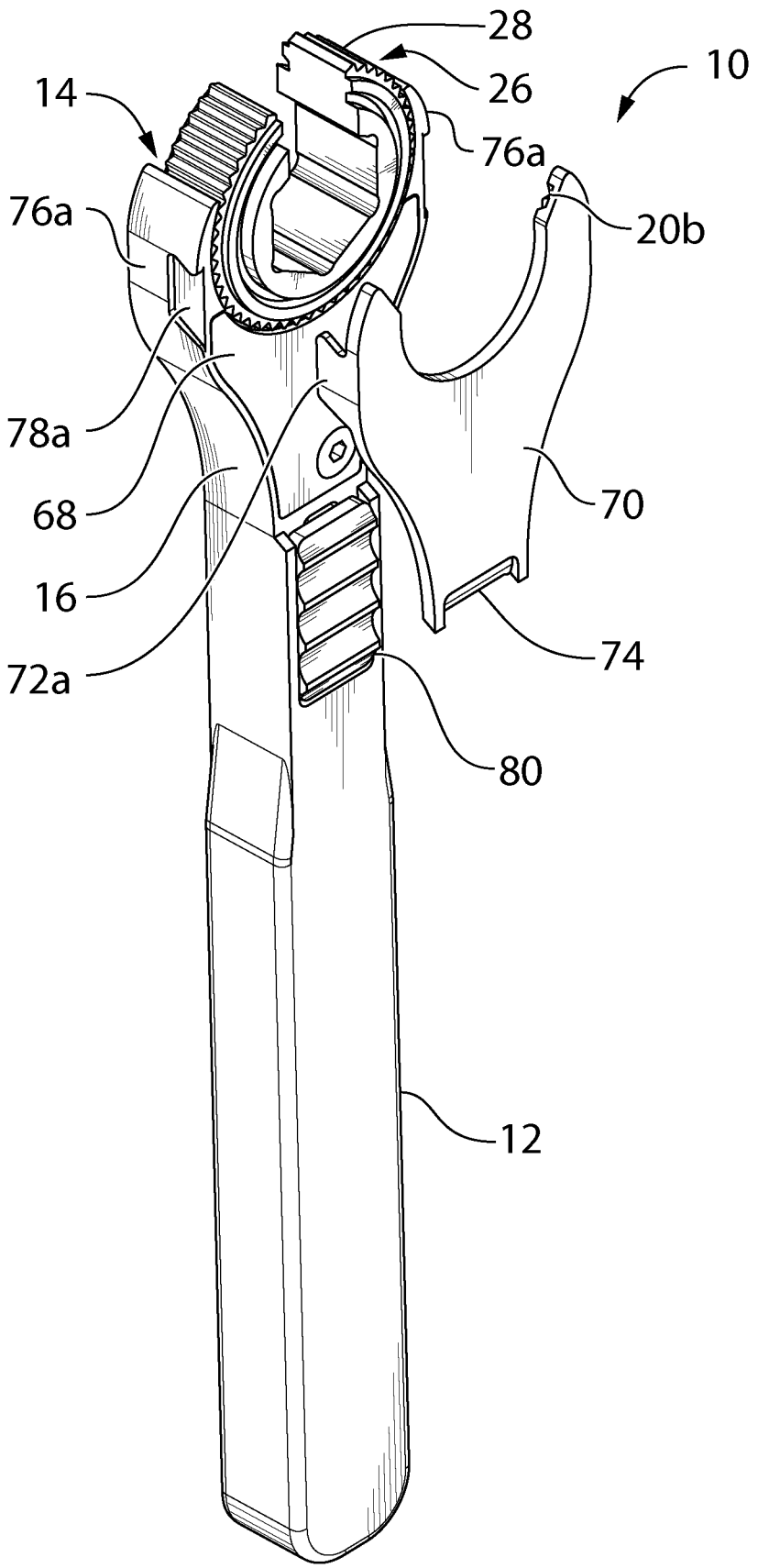
FIG. 2 is a perspective view of the embodiment of FIG. 1 with the wrench head retaining cover removed.
Figure 3:
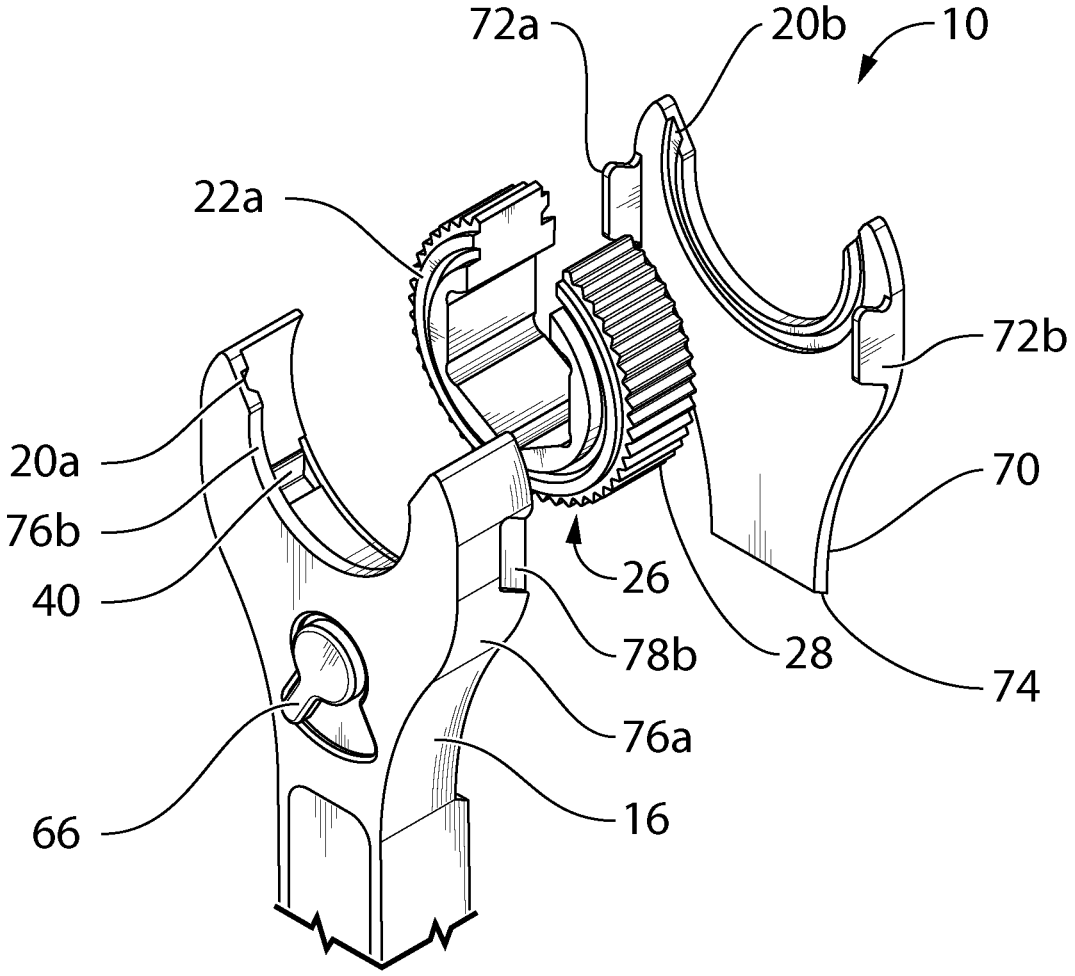
FIG. 3 is an exploded perspective view of the fitting engaging region of the ratchet assembly with the wrench head retaining cover removed and an interchangeable fitting engageable wrench head uninstalled.

With reference to FIG. 1, there is shown an embodiment of the ratchet assembly for use with rotatable fittings 10, as described herein. A wrench body 16 is intervened by a handle portion 12 on which a user may apply force to pivotally rotate the handle portion 12 about an axis of rotation located at the center of a fitting engaging region 14, as with wrenches commonly known in the art. The ratchet assembly 10, in one embodiment has a fitting engageable wrench head 26, and in other embodiments, the fitting engageable wrench head 26 is provided as at least one interchangeable wrench head 82, as indicated, for example and shown in FIGS. 9 and 10*a* through 10*i*. Furthermore, the fitting engageable wrench head 26, or interchangeable wrench heads 82, may be provided in various sizes for use with a variety of corresponding and complementary fittings, as is known in the art. Additionally, the fitting engageable wrench head 26, or interchangeable wrench heads 82 may be provided as, but not limited to, a line wrench sprocket wrench head, a line wrench socket wrench head, an open-sided sprocket wrench head, an open-sided socket wrench head, a box-end sprocket wrench head, a pass-through socket wrench head, a driver-bit wrench head, a screwdriver wrench head or a universal socket adapter wrench head. FIGS. 1, 2 and 3, for example, shows the ratchet assembly 10 with a line wrench sprocket wrench head 82*c* (see FIG. 10*c*) received and installed in the fitting engaging region 14. Accordingly, in various embodiments, different wrench heads 26 may be installed in the fitting engageable region 14 for use with a variety of correspondingly complementary fittings and in some embodiments, a variety of interchangeable wrench heads 82 may be provided which can be interchangeably installed in the fitting engaging region 14 for use, as required.

Continuing now with reference to FIG. 3, the ratchet assembly 10, is provided with wrench body arcuate mating feature 20*a*, which in some embodiments may take the form of an arcuate channel located near and circumscribing the interior periphery 76*b* of the fitting engaging region 14. The wrench body arcuate mating feature 20*a* is fashioned to complementarily receive, or otherwise operably mate with, a head arcuate mating feature 22*a* located near the periphery of a fitting engageable wrench head 26. A removable wrench head retaining cover 70, as shown in FIG. 3, for example, may be provided in some embodiments, which similar to the fitting engaging region 14 described above, may have an arcuate cover mating feature 20*b*, and in some embodiments the arcuate cover mating feature 20*b* may be provided as an arcuate channel. The arcuate cover mating feature 20*b* is fashioned to operably mate with a second head arcuate mating feature 22*b*, such as that shown in FIGS. 1 and 2 and further in FIG. 9, for example. In embodiments where the ratchet assembly 10 is designed such that wrench heads 26 are not interchangeable, the wrench head retaining cover 70 may not be readily removable, or permanently installed or coupled with wrench body 16 such that the wrench head 26 may not be removed. With a fitting engageable wrench head 26 installed in the fitting engaging region 14 of the wrench body 16, the wrench body arcuate mating feature 20*a*, and in some embodiments, the cover arcuate mating feature 20*b*, operably mate with the head arcuate mating feature(s) (22*a*/22*b*) and allow the wrench head 26 to rotate in the fitting engaging region 14 relative the wrench body 16 guided about an axis of rotating by the mating features. The user-selectivity function of the rotation the wrench head 26 relative the wrench body 16 is discussed in more detail below pertaining to the ratchet mechanism provided herein.

Figure 4:
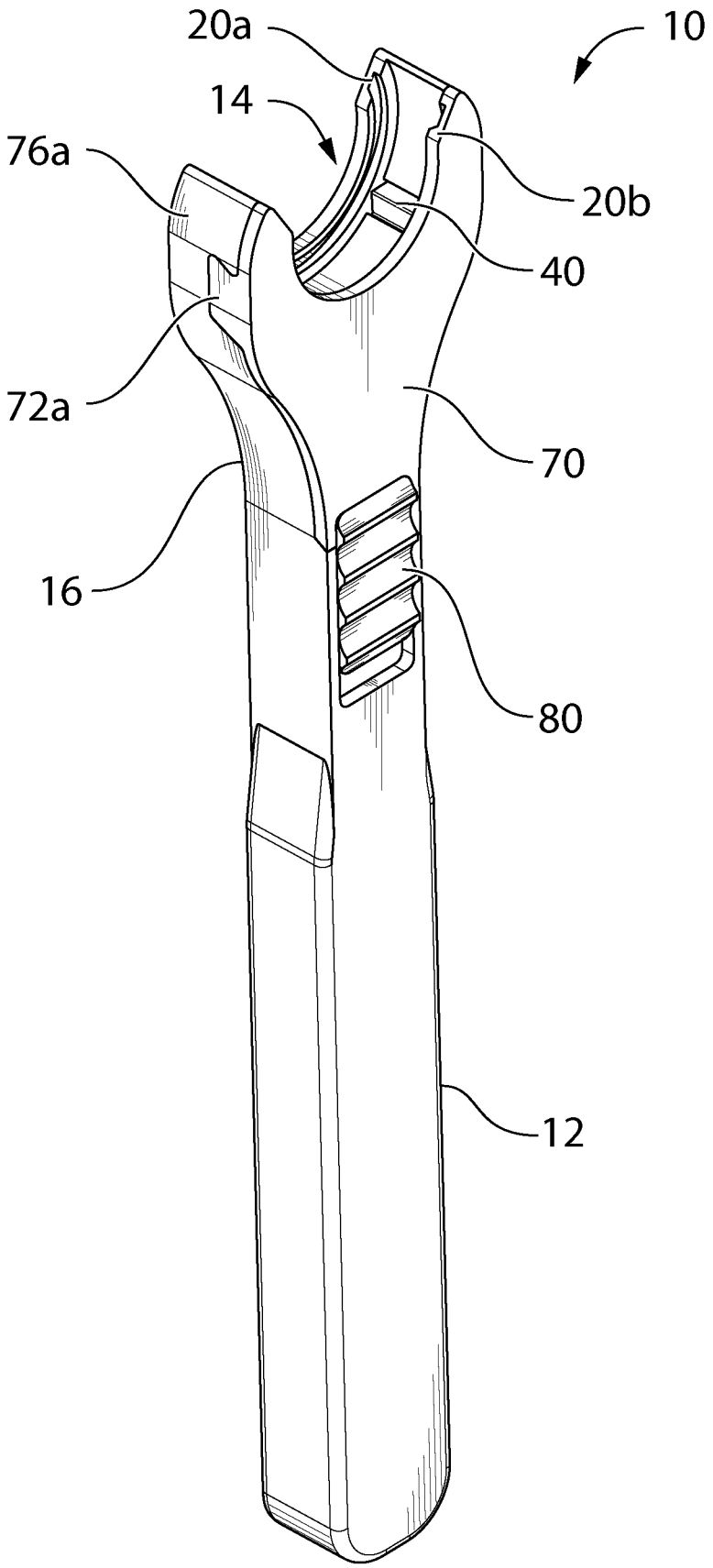
FIG. 4 is a perspective view of the interchangeable wrench head ratchet assembly of FIG. 1 with the wrench head retaining cover installed.

FIG. 4 shows the wrench head retaining cover 70 installed on the wrench body 16 with a first wrench head retaining cover tab 72*a* received in a first tab receiving region 78*a* (see FIG. 2) located near a fitting engaging region exterior periphery 76*a*. FIG. 3 shows, as provided in preferred embodiments, a second wrench head retaining cover tab 72*b* and a second tab receiving region 78*b*, which although not shown in the figures, mate when the wrench head retaining cover 70 is installed on the wrench body 16. The first wrench head retaining cover tab 72*a* and the first tab receiving region 78*a*, and in some embodiments, the second wrench head retaining cover tab 72*b* and the second tab receiving region 78*b*, as shown in FIG. 5*b*, as well as other figures, are designed to interlock. For example, as shown herein the wrench head retaining cover tabs 78*a/b* may have a modified parallelogram shape and the tab receiving regions are correspondingly complementarily shaped such that the wrench head retaining cover 70 must be pivoted relative the wrench body 16 so as to uncouple or install the wrench head retaining cover 70 with the wrench body 16 for removing or installing a wrench head 26 or an interchangeable wrench head 82, as desired in the fitting engaging region 14.

In order that the wrench head retaining cover 70 may be reversibly coupled to the wrench body 16 and pivotally uncoupled, the wrench head retaining cover 70, in some embodiments, is provided with a proximal holding clip mating region 74 which mates with a complementary formation on the wrench body 16. A wrench head retaining cover holding clip 80 then maintains proximal holding clip mating region 74 in communication with wrench body 16, as shown FIGS. 1, 4, 5*b* and 5*c*, for example. The wrench head retaining cover holding clip 80 is operably coupled to the wrench body 16 and slidable along a defined portion of the wrench body 16. In preferred embodiments, the wrench head retaining cover holding clip 80 is resiliently biased in the direction of the fitting engaging region 14 such that the bias acts to have a portion of the wrench head retaining cover holding clip 80 overlap a portion of the proximal holding clip mating region 74. Thus with the wrench head retaining cover tabs 72*a/b* and the tab receiving regions 78*a/b* in operable communication, the wrench head retaining cover 70 is coupled to the wrench body 16. Accordingly, the wrench head retaining cover 70 is thereby coupled to the wrench body 16 and the wrench head 26 or an interchangeable wrench head 82 can be operably maintained in the fitting engaging region 14. To remove an interchangeable wrench head 82 from the fitting engaging region 14, for example, the wrench head retaining cover holding clip 80 is slid against the resilient bias toward the handle potion 12 so as to disengage with the portion of the proximal holding clip mating region 74 and the proximal holding clip mating region 74 is then lifted relative the wrench body 16 and the wrench head retaining cover tabs 72*a* are thus pivotally uncoupled from the tab receiving regions 78*a/b* such the wrench head retaining cover 70 can be uncoupled from the wrench body 16. With the wrench head retaining cover 70 uncoupled, the interchangeable wrench head 82 may be removed or installed in the fitting engaging region 14, thus providing a means to interchange various interchangeable wrench heads 82, such as those shown, for example, in FIGS. 10*a* to 10*i*.

Figure 6:
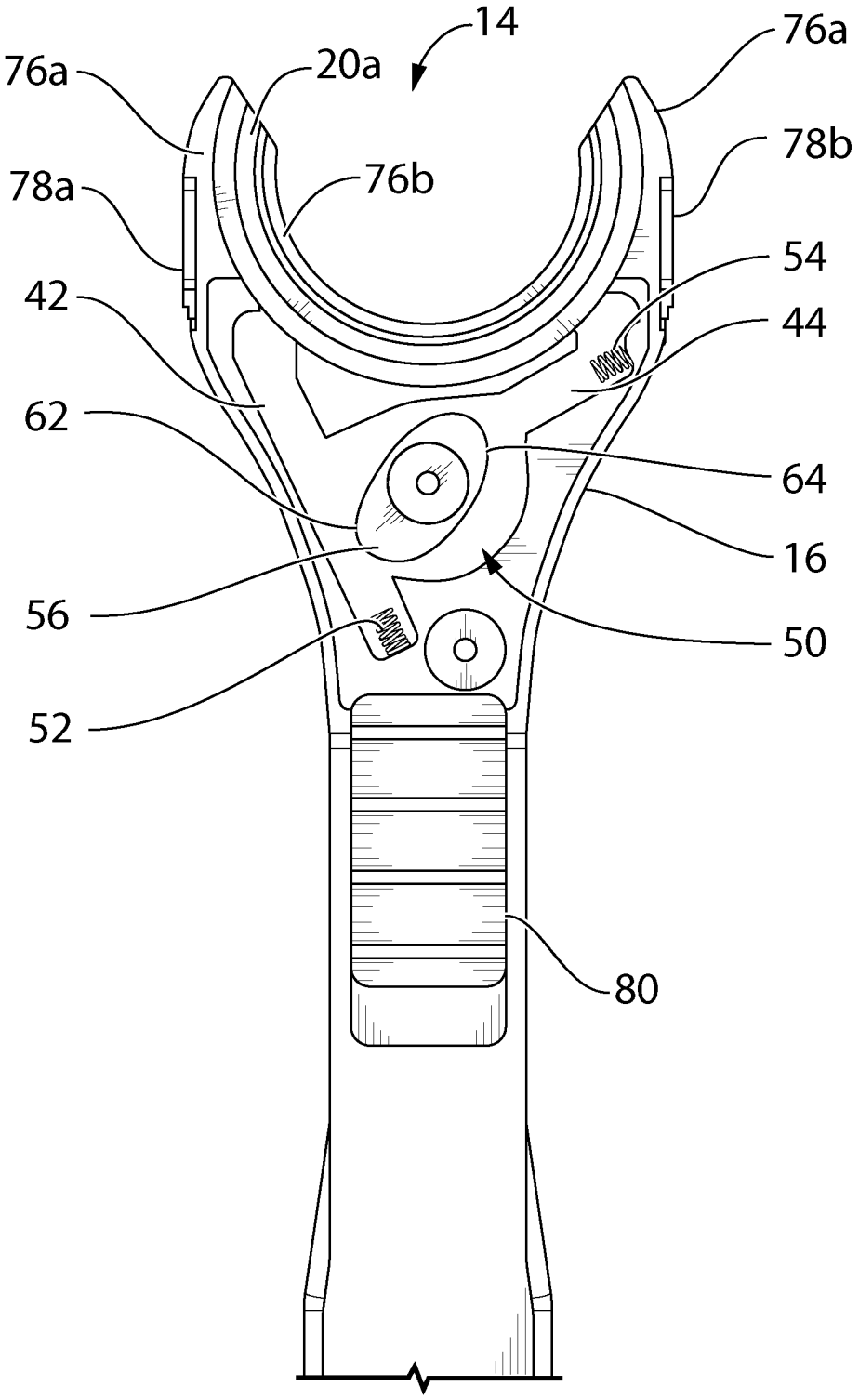
FIG. 6 is a top-plan view of the fitting engaging region of the ratchet assembly with the pawl mechanism cover removed showing the first and second pawl receiving channels.
Figure 7A:
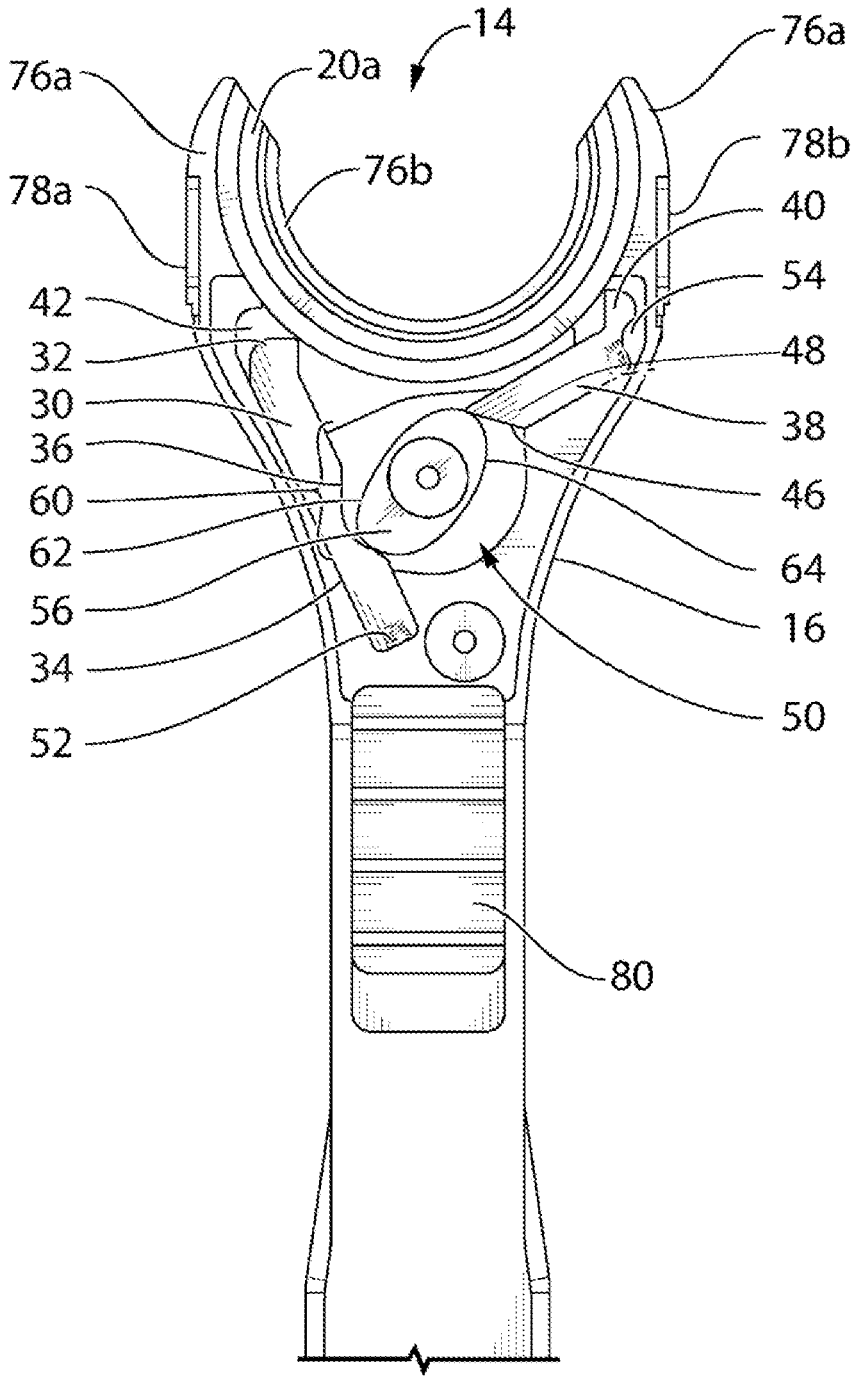
FIG. 7*a* is the top-plan view of FIG. 6 with the first and second pawls installed in the first and second pawl receiving channels and the rotatable pawl disengager in the second pawl disengager orientation.
Figure 7B:
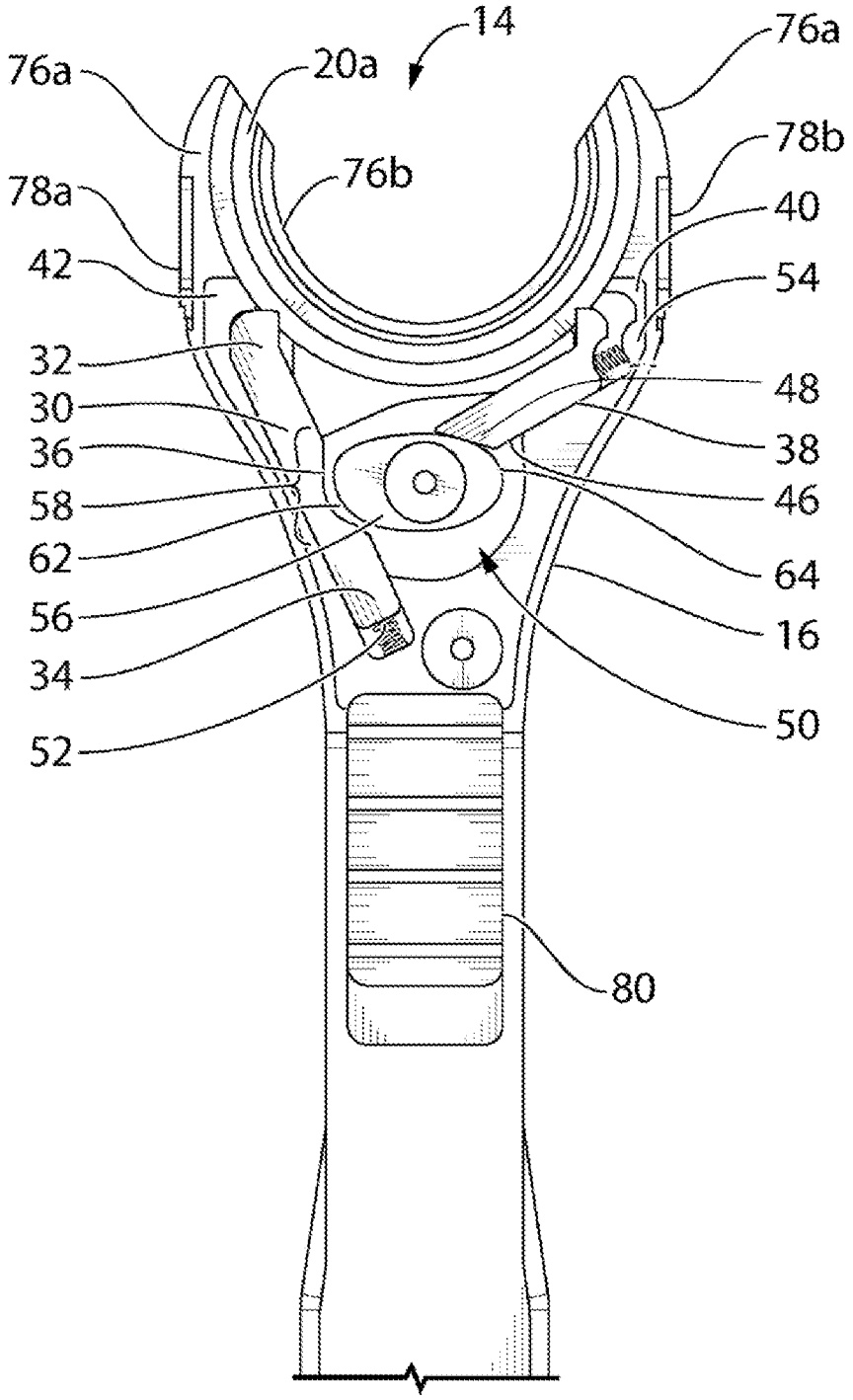
FIG. 7*b* is the top-plan view of FIG. 6 with the first and second pawls installed in the first and second pawl receiving channels and the rotatable pawl disengager in the first pawl disengager orientation.

Turning now to FIG. 6, the two-pawl mechanism for allowing either free rotation and/or removal and installation of the fitting engageable wrench head 26, in some embodiments, (interchangeable wrench head 82) or single direction rotation of the wrench body 16 relative the fitting engageable wrench head 26 towards said first pawl 30 is described below. In the wrench body 16, proximal to the fitting engaging region 14 are located a first pawl receiving channel 42 and a second pawl receiving channel 44. In some embodiments, a pawl mechanism cover plate 68 is provided, as shown in FIG. 2, which may be removably coupled to the wrench body 16. The pawl mechanism cover plate 68 is dimensioned and shaped to cover the first and second pawl receiving channels 42 and 44 as well as a pawl disengager region 50 joining the first and second pawl receiving channels 42 and 44, for enclosing and substantially sealing the first and second pawls 30 and 38 respectively in the first and second pawl receiving channels 42 and 44 and the rotatable pawl disengager 36 in the wrench body 16. Both the first and second pawl receiving channels, 42 and 44, are each sized to allow independent linear movement in one axis of a first pawl 30 and a second pawl 38 respectively received therein as shown in FIGS. 7*a* and 7*b*. The pawl mechanism cover plate 68, in one aspect serves to maintain the first and second pawls 30 and 38 slidably in the respective first and second pawl receiving channels 42 and 44 as well as offer a degree of protection for the pawl mechanism and the a rotatable pawl disengager 56, which is discussed in more detail below, from the elements. In other words, the first and second pawls 30 and 38, may slide respectively in the first and second pawl receiving channels 42 and 44 such that they can independently engage with space-apart teeth 28 located about the periphery of a substantially cylindrically-shaped cogged head 18 of a fitting engageable wrench head 26 (interchangeable wrench head 82), as shown, for example in FIGS. 8*a* and 8*b*. As noted above, located between and joining the first and second pawl receiving channels 42 and 44 is the pawl disengager region 50 which is disposed in the wrench body 16 having located therein the rotatable pawl disengager 56, which is discussed in more detail below.

Figure 8A:
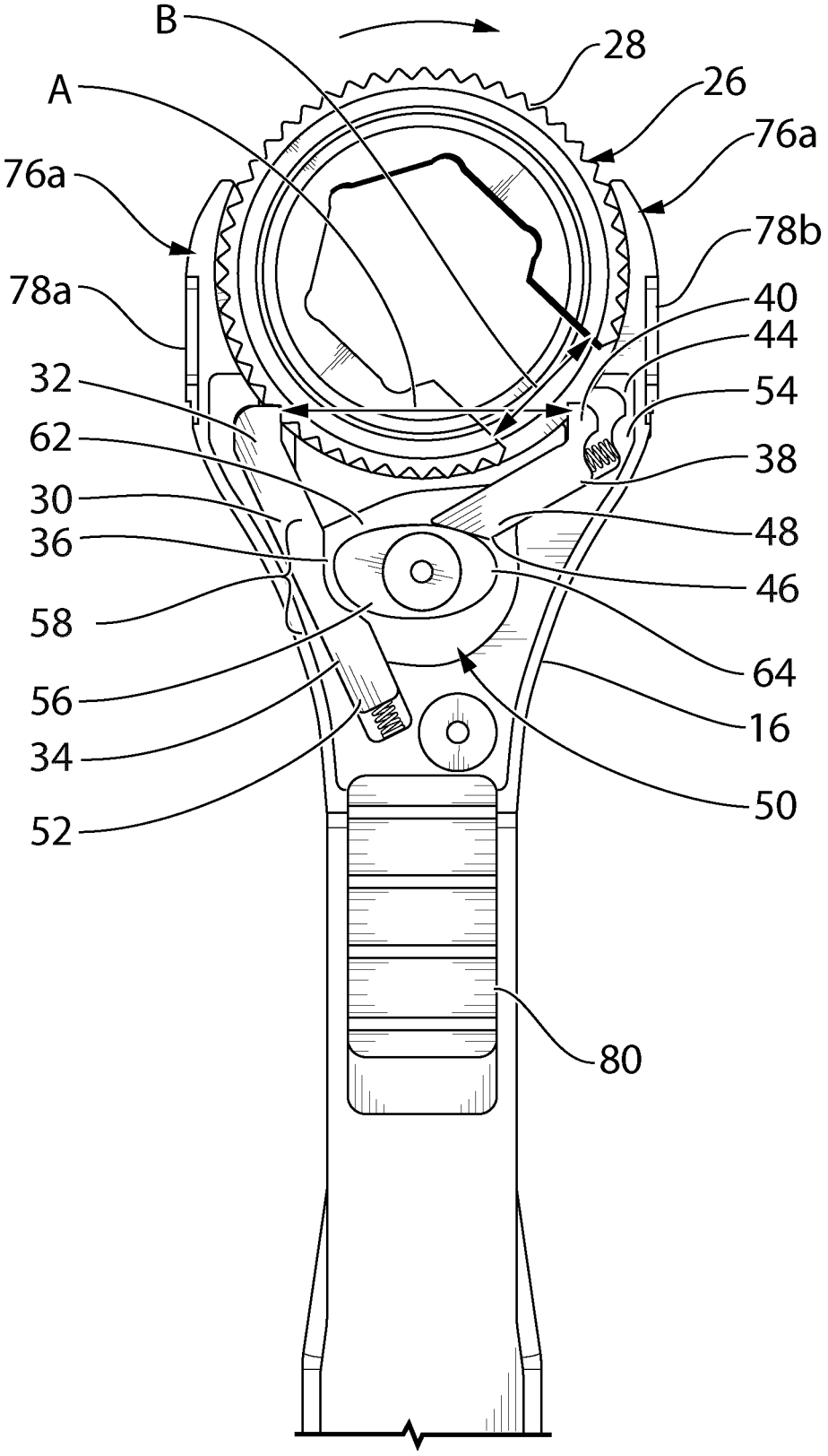
FIG. 8*a* is a top-plan view of FIG. 7*b* with an open-sided fitting engageable wrench head installed in the fitting engaging region with only the tooth-engaging hooking distal end region engaged with teeth.

With reference to FIG. 6, the first pawl receiving channel 42 is oriented substantially such that the first pawl 30, when received therein, can move substantially in an axis in-line with the handle portion 12. In this regard a tooth-engaging hooking distal end region 32 of the first pawl 30, when the rotatable pawl disengager 56 is a first pawl disengager orientation, or tooth-engaged position, 58, as shown in FIGS. 7*b* and 8*a/b*, can engage the spaced-apart teeth 28 under the resilient bias of first spring 52 located to act on a first proximal end region 34 of the first pawl 30. First spring 52, located in the proximal end region 34 of the first pawl receiving channel 42 biases the first pawl 30 toward the distal end region of the first pawl receiving channel 42 where the tooth-engaging hooking distal end region 32 protrudes into the interior of the fitting engaging region 14 such that it can interact with the spaced-apart teeth 28, as shown in FIG. 7*b*. FIG. 8*a* shows that interaction tooth-engaging hooking distal end region 32 with the spaced-apart teeth 28. Due to the "hooking" shape of the tooth-engaging hooking distal end region 32, when the rotatable pawl disengager 56 is in the first pawl disengager orientation 58, the tooth-engaging hooking distal end region 32 engages with the spaced-apart teeth 28, yet when the handle portion is rotated such that it pivots about an axis of rotation at the center of the fitting engaging region 14 toward the first pawl 30, for example when engaged with a rotatable fitting, the space-apart teeth 28 cause the first pawl 30 slide in the first pawl receiving channel 42 against the bias of the first spring 52. Thus, the tooth-engaging hooking distal end region 32 moves out of the spaced-apart teeth 28 to allow the ratcheting action. When the handle portion 12 is pivoted in the other direction, that being about an axis of rotation at the center of the fitting engaging region 14 toward the second pawl 38, the "hooking" shape to the tooth-engaging hooking distal end region 32 does not force the first pawl 30 to slide in the first pawl receiving channel 42, with the first spring 52 firmly seating the tooth-engaging hooking distal end region 32 in the space-apart teeth 28 such that the fitting engageable wrench head 26 (interchangeable wrench head 82) rotates with the wrench body 16.

Figure 8B:
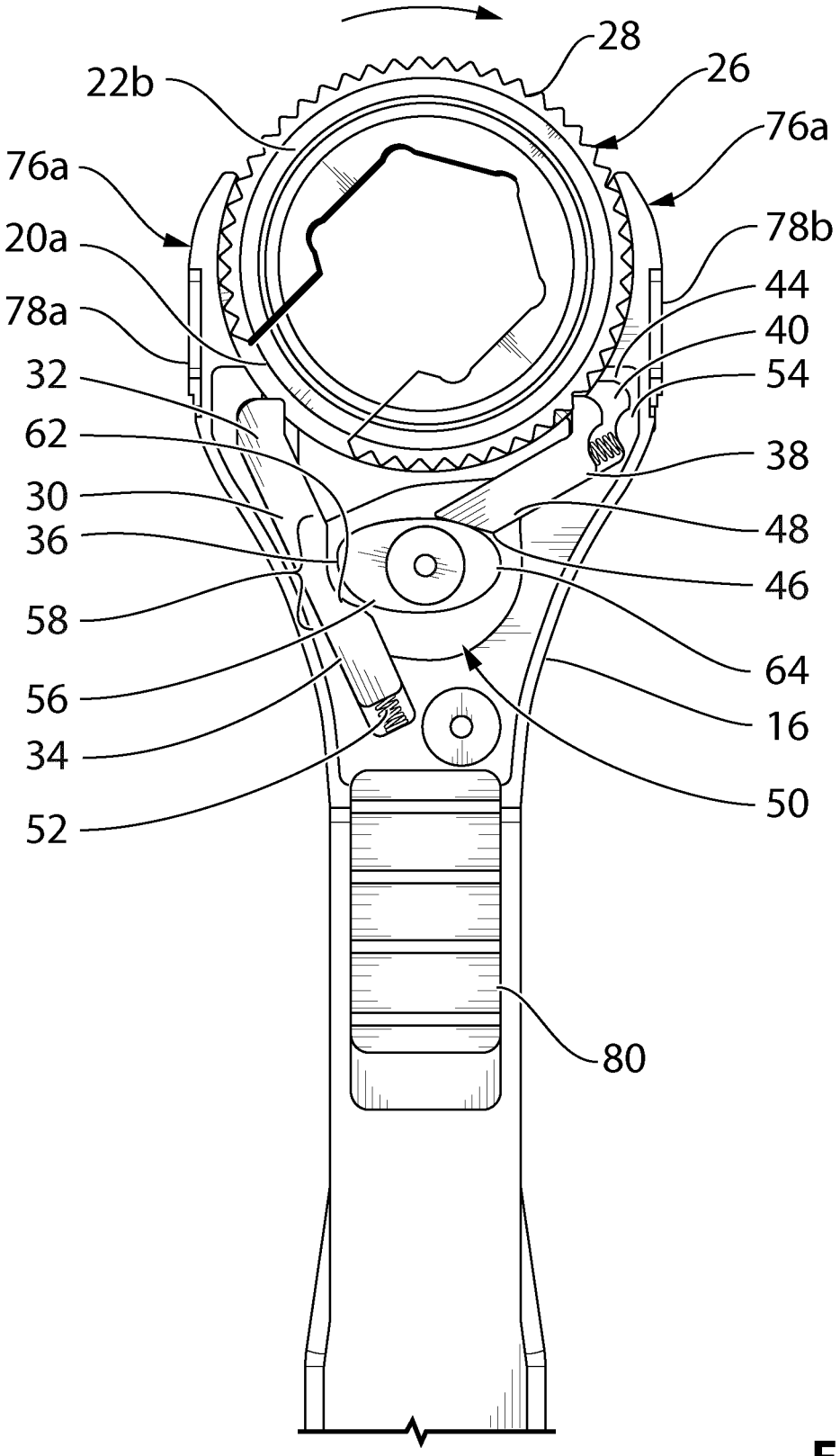
FIG. 8*b* is a top-plan view of FIG. 8*a* with only the tooth-engaging abutting distal end region engaged with teeth.

Again, with reference to FIG. 6, the second pawl receiving channel 44 is orientated substantially tangential to the wrench body arcuate mating feature 20*a* of the fitting engaging region 14, such that when the second pawl 38 is received therein, it can slide in an axis substantially tangential to the wrench body arcuate mating feature 20*a*. The second pawl 38 has a tooth-engaging abutting distal end region 40 which protrudes into the interior of the fitting engaging region 14 such that it can interact with the spaced-apart teeth 28, as shown in FIGS. 7*b* and 8*b*, when the rotatable pawl disengager 56 is in the first pawl disengager orientation 58. With the rotatable pawl disengager 56 in the first pawl disengager orientation 58, the second pawl is resiliently biased towards the pawl disengager region 50 by a second spring 54 located in the second pawl receiving channel 44 to act on a second pawl proximal end region 48 of the second pawl 38, as shown in FIGS. 7*b* and 8*a/b*. Similar to the first pawl action as described above, the "abutting" shape of the tooth-engaging abutting distal end region 40 allows the second pawl 38 to slide in the second pawl receiving channel 44 toward the exterior peripheral area 76*a* when the handle portion is rotated such that it pivots about an axis of rotation at the center of the fitting engaging region 14 toward the first pawl 30, for example when engaged with a rotatable fitting. Thus, the space-apart teeth 28 cause the second pawl 38 to slide in the second pawl receiving channel 44 against the bias of the second spring 54 in order that the tooth-engaging abutting distal end region 40 moves out of the spaced-apart teeth 28 to allow for the ratcheting action. When the handle portion is pivoted in the other direction, that being about an axis of rotation at the center of the fitting engaging region 14 toward the second pawl 38, the "abutting" shape to the tooth-engaging abutting distal end region 40 does allow the second pawl 38 to be forced to slide in the second pawl receiving channel 44, with the second spring 54 firmly seating the tooth-engaging abutting distal end region 40 in the space-apart teeth 28 such that the fitting engageable wrench head 26 (interchangeable wrench head 82) rotates with the wrench body 16. That being, the spaced-apart teeth 28 abut against the tooth-engaging abutting distal end region 40 when the handle portion 12 is pivoted towards the second pawl 38.

Figure 10A:
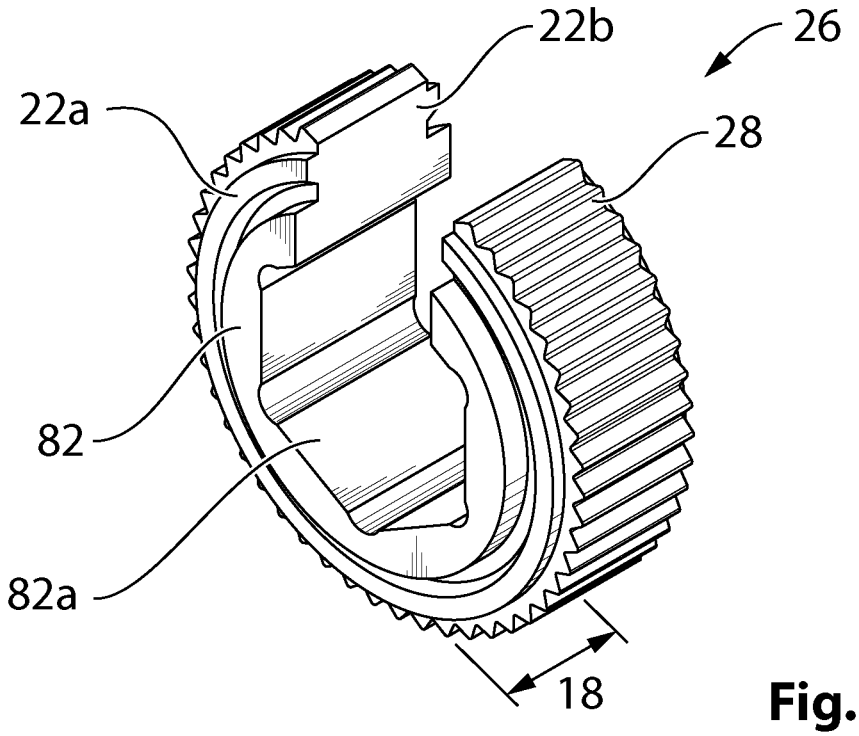
FIGS. 10*a* to 10*i* are perspective views of various exemplary fitting engageable interchangeable wrench heads complementarily engageable with a variety fittings and installable in the fitting engaging region of the interchangeable wrench head ratchet assembly.
Figure 10B:
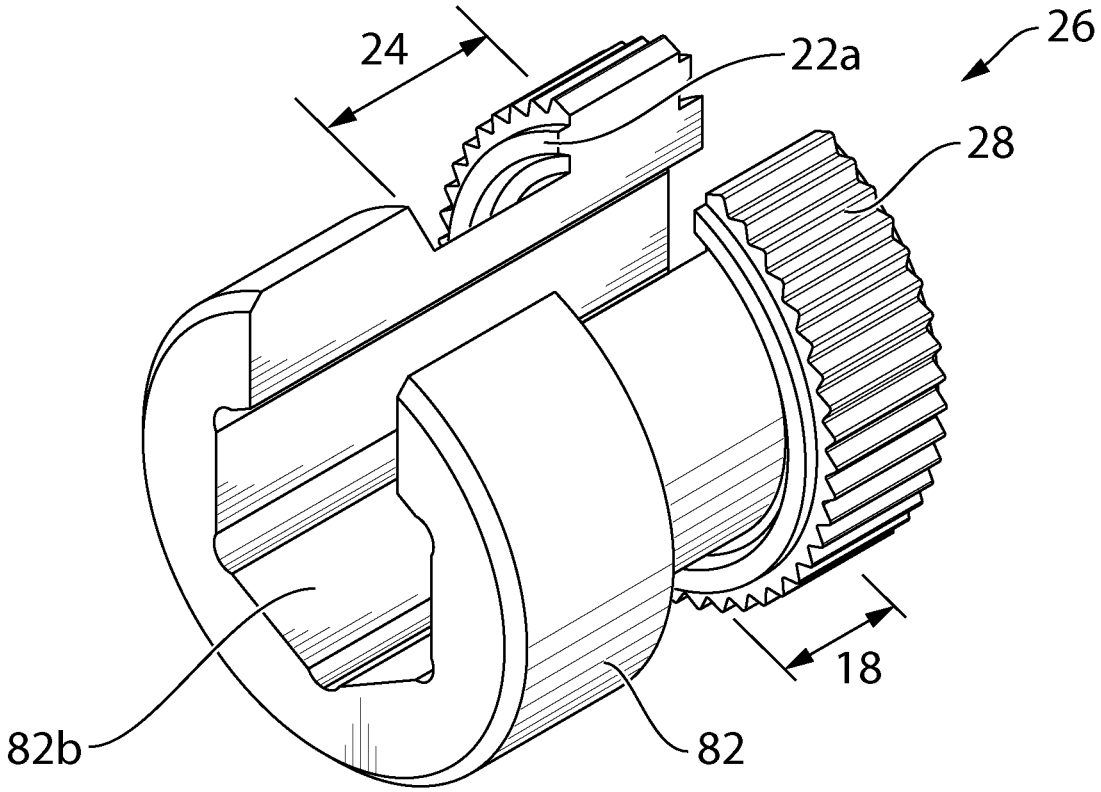
Figure 10C:
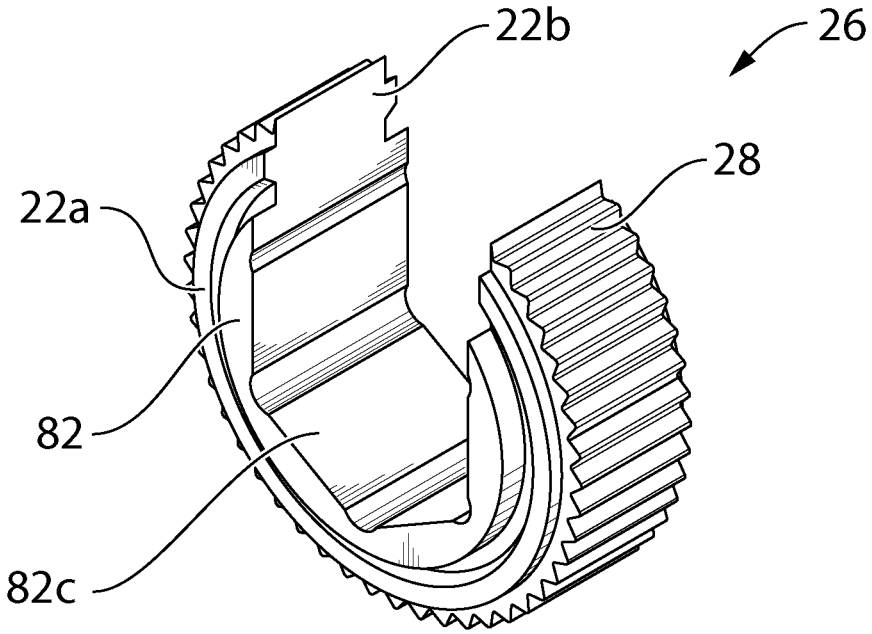
Figure 10D:
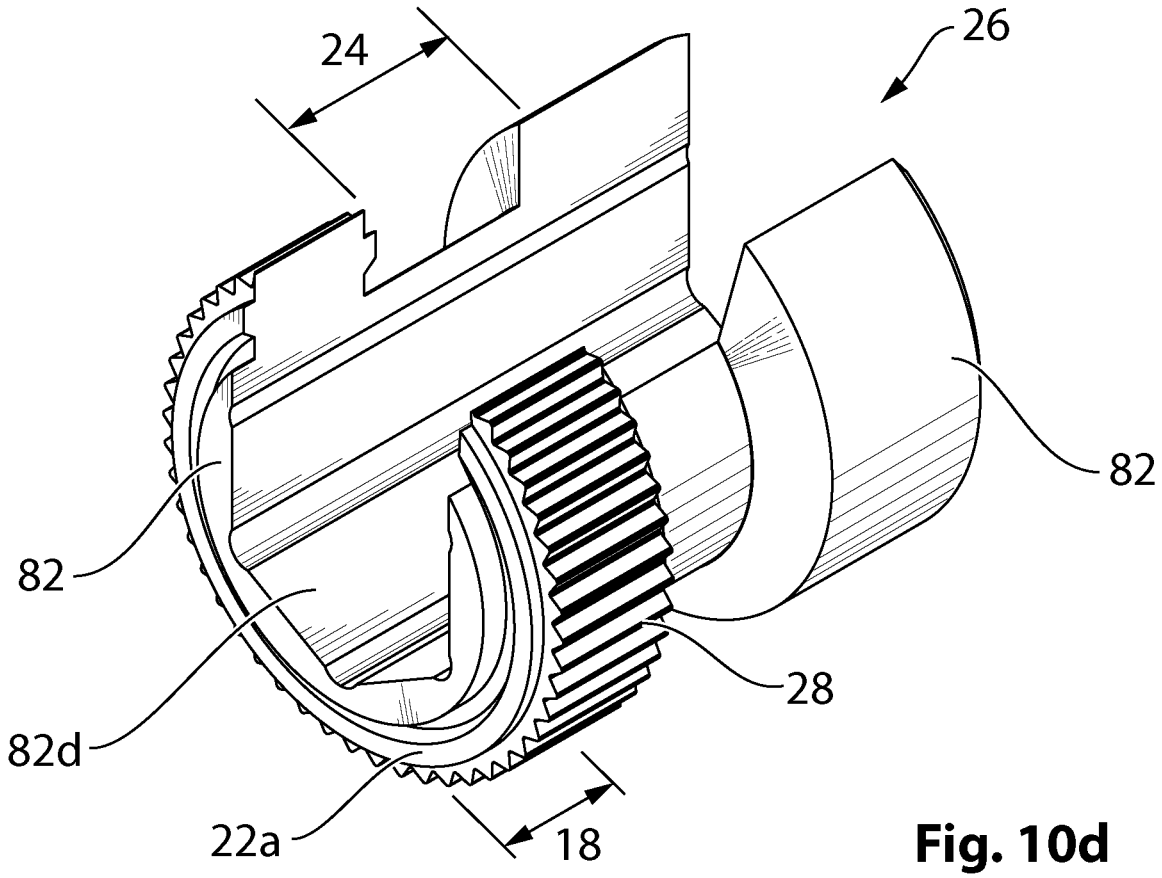
Figure 10E:
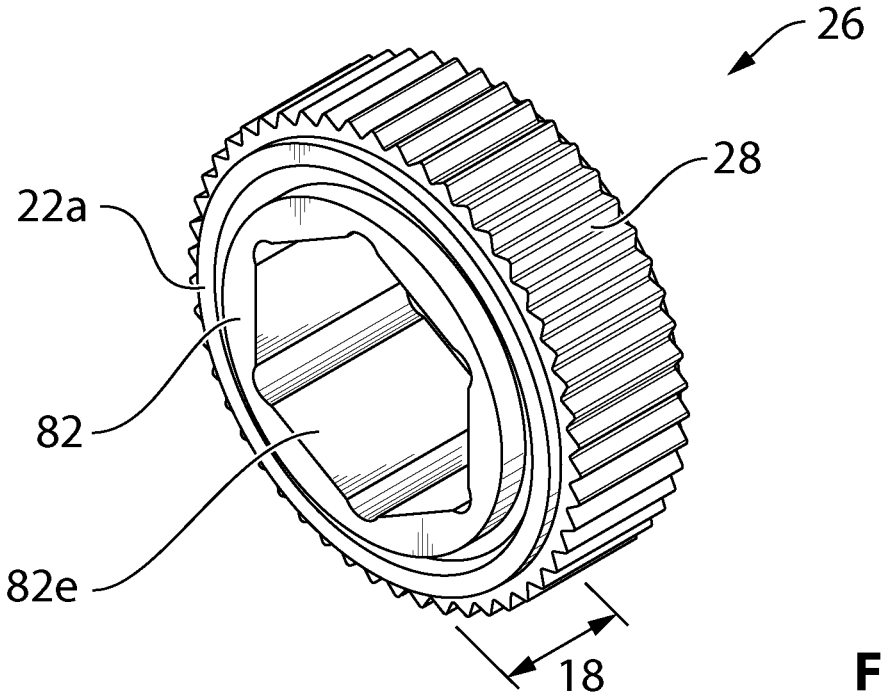
Figure 10F:
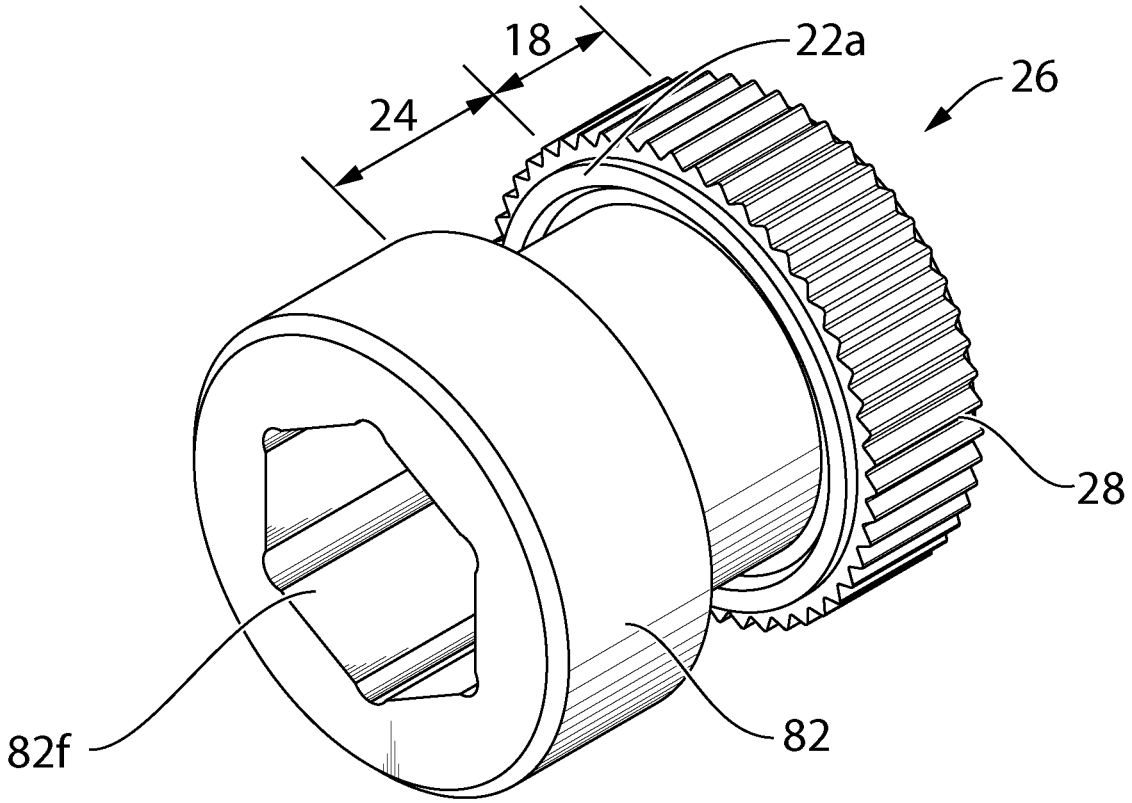
Figure 10G:
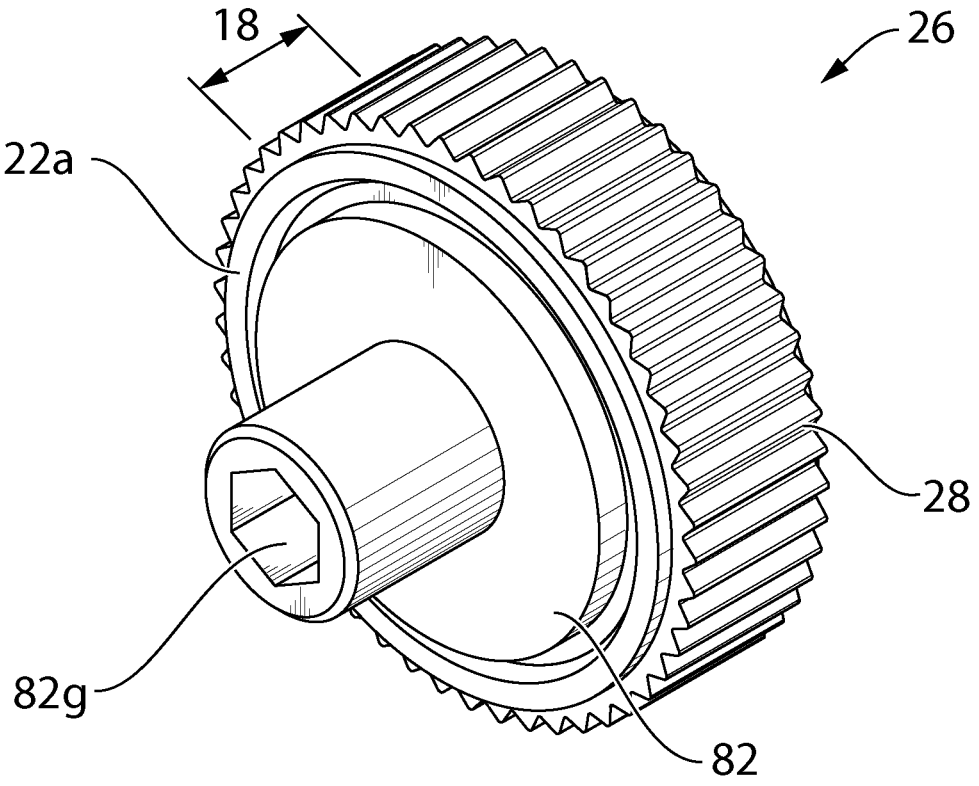

In the ratchet assembly 10 described herein, both the first and second pawls 30 and 38 may engage spaced-apart teeth 28 at the same time, such as for example with a pass-through wrench head 82*f* (FIG. 10*f*), to provide the ratcheting action. However, the ratchet assembly 10 described herein having independently moveable first and second pawls 30 and 38 which are independently slidable, respectively, in first and second pawl receiving channels 42 and 44 as discussed above, may also allow for a ratcheting action and tightening/loosening of rotatable fittings with line wrench sprocket heads 82*a* (FIG. 10*a*), line wrench socket heads 82*b* (FIG. 10*b*), open-sided sprocket wrench heads 82*c* (FIG. 82*c*) and/or open-sided socket wrench heads 82*d* (FIG. 10*d*). For example, as shown in FIGS. 8*a* and 8*b*, as the open side of certain wrench heads pass under the ratchet action across, for example with respect to FIG. 8*a*, the tooth-engaging abutting distal end region 40 of the second pawl 38 such that is not engaged with the space-apart teeth 28, the tooth-engaging hooking distal end region 32 of first pawl is still engaged with the space-apart teeth 28. Thus, the rotatable fitting can be rotated as the handle portion 12 is pivoted in the direction of the second pawl 38. When the handle portion 12 is pivoted towards the first pawl 30 the fitting engageable wrench head 26 (interchangeable wrench head 82) ratchets or advances relative the wrench body 16 such that at some point the tooth-engaging abutting distal end region 40 of the second pawl 38 again engages space-apart teeth 28 and then at point of further advance, the open side of the wrench head passes the tooth-engaging hooking distal end region 32 of the first pawl 30 such the tooth-engaging hooking distal end region 32 is not engaged with the spaced-apart teeth 28, as shown in FIG. 8*b*. With the tooth-engaging hooking distal end region 32 not engaged with the spaced-apart teeth 28, as shown in FIG. 8*b*, the tooth-engaging abutting distal end region 40 of the second pawl 38, being engaged with the spaced-apart teeth 28, allows the rotatable fitting to be rotated as the handle portion 12 is pivoted toward the second pawl 38. When the handle portion 12 is again pivoted towards the first pawl 30 the fitting engageable wrench head 26 (interchangeable wrench head 82) ratchets or advances relative the wrench body 16 such that at some point the tooth-engaging hooking distal end region 32 of the first pawl 30 and tooth-engaging abutting distal end region 40 of the second pawl 38 again engage space-apart teeth 28. One of skill in the art will note that a cord A (see FIG. 8*a*) created across the wrench body arcuate mating feature 20*a*, for example, between tooth-engaging hooking distal end region 32 of the first pawl 30 and tooth-engaging abutting distal end region 40 of the second pawl 38 must be longer than the distance B across the open side of a certain wrench head 26 so as to ensure that at least one of the first or second pawls 30 or 38 is engageable with spaced-apart teeth 28 as any given point of rotation. Thus, as sequentially and schematically shown in FIGS. 8*a* and 8*b*, the two-pawl ratchet mechanism of the ratchet assembly 10 described herein allows for the use of open-side wrench heads to ratchet tighten or loosen rotatable fittings.

The rotatable pawl disengager 56, in some embodiments may be rotated between the first pawl disengager orientation 58, where the first and second pawls 30 and 38 are allowed to be independently slidable in the respective first and second pawl receiving channels 42 and 44 and resiliently biased such that the tooth-engaging hooking distal end region 32 and tooth-engaging abutting distal end region 40 can reversibly slidably communicate with the spaced-apart teeth 28 as shown in FIG. 7*b* and discussed above. In the first pawl disengager orientation 58 (FIGS. 8*a* and 8*b*), the tooth-engaging hooking distal end region 32 and tooth-engaging abutting distal end region 40 communicate with the spaced-apart teeth 28 such that the wrench body 16 is only rotatable relative the fitting engageable wrench head 26 (interchangeable wrench head 82) in a direction towards said first pawl 30 when a directional force is applied to the handle portion 12 in the opposite direction. Thus, the ratchetable action is provided. When a directional force is applied to the handle portion 12 in the other direction (on the first pawl 30 side and in a direction toward the second pawl 38 side), the tooth-engaging hooking distal end region 32 and tooth-engaging abutting distal end region 40 engage with the spaced-apart teeth 28 to a allow a wrenching action such that a rotatable fitting may be rotated.

The rotatable pawl disengager 56 can also be rotated to a second pawl disengager orientation, or tooth-disengaged position, 60, shown in FIG. 7*a*, where tooth-engaging hooking distal end region 32 and tooth-engaging abutting distal end region 40 are withdrawn from the spaced-apart teeth 28, toward the ends of the first and second pawl receiving channels 42 and 44, respectively, where the first and second springs 52 and 54 are located. With the rotatable pawl disengager 56 in the second pawl disengager orientation 60, the tooth-engaging hooking distal end region 32 and tooth-engaging abutting distal end region 40 are withdrawn from the fitting engaging region 14, shown in FIG. 7*a*. In the second pawl disengager orientation 60, with the first and second pawls 30 and 38 withdrawn, the fitting engageable wrench head 26 (interchangeable wrench head 82) can freely rotate along a path defined by the slidable mating of the wrench body arcuate mating feature 20*a* and the cover arcuate mating feature 20*b* communicating with the head arcuate mating features 22*a/b*. Also, in some embodiments, when the wrench head retaining cover 70 is removed, as described above, with the first and second pawls 30 and 38 withdrawn by virtue of the rotatable pawl disengager 56 being in the second pawl disengager orientation 60 an interchangeable wrench head 82 may be removed or installed in the fitting engaging region 14. Having said this, although not shown in the figures, one of skill may recognize that an interchangeable wrench head 82 may be installed or removed without the pawl disengager 56 in the second pawl disengager orientation 60; that being in the first pawl disengager orientation 58. In such an action, the tooth-engaging hooking distal end region 32 and tooth-engaging abutting distal end region 40 of the first and second pawls 30 and 38 are interlaced between some the of the spaced-apart teeth 28 by a user rotating the interchangeable wrench head 82 in the fitting engaging end region 14 such that wrench head 26 is installed therein and the respective arcuate mating features mated. This action may thus be reversed to remove the interchangeable wrench head 82 from the fitting engaging end region 14.

Figure 5A:
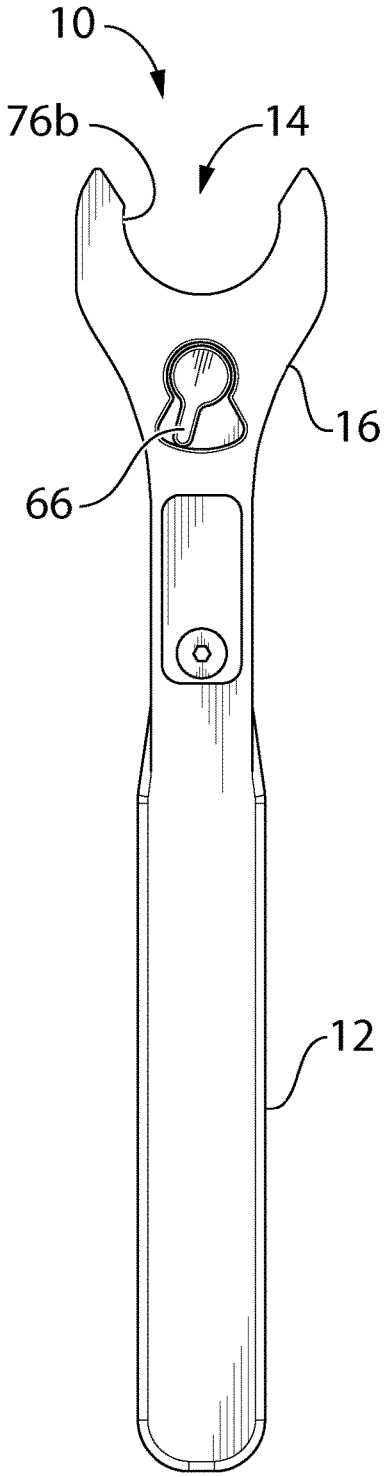
FIG. 5*a* is a bottom-plan view of FIG. 4.
Figure 5B:
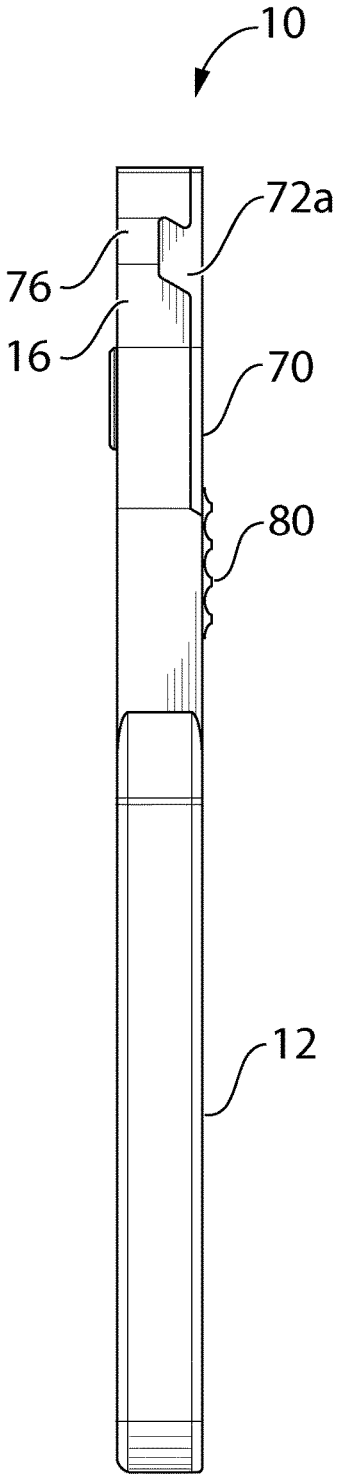
FIG. 5*b* is a side view of FIG. 4.
Figure 5C:
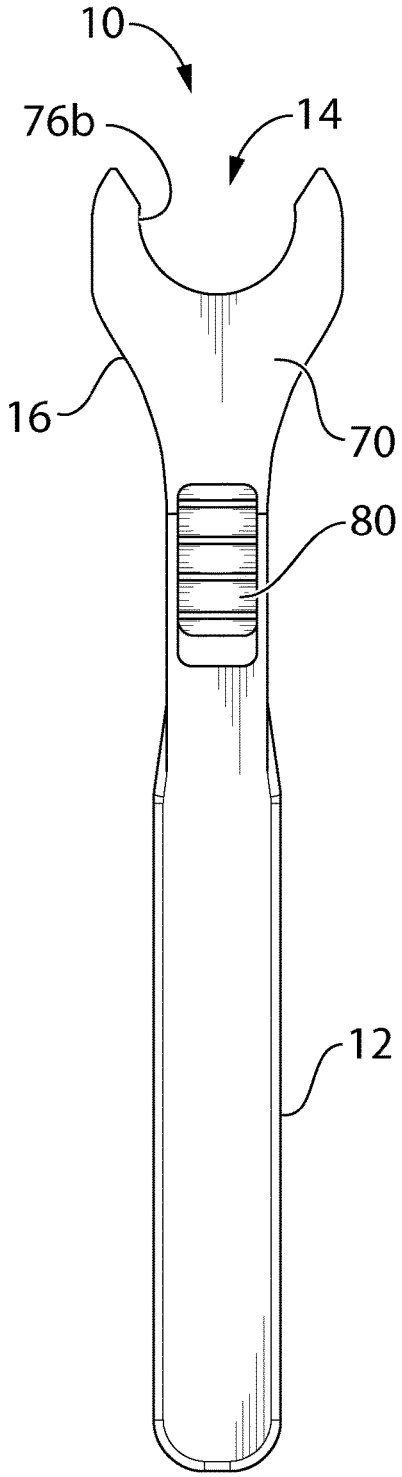
FIG. 5*c* is a top-plan view of FIG. 4.

FIGS. 3 and 5*a* show a rotatable pawl disengager lever 66, which, in some preferred embodiments may be connected to the rotatable pawl disengager 56 by a shaft (not shown) depending through an orifice or opening in the wrench body 16. Pivotal movement of the rotatable pawl disengager lever 66 accordingly effects rotation of the rotatable pawl disengager 56 in the pawl disengager region 50, which in turn effects movement of the first and second pawls 30 and 38 to be either engageable with the spaced-apart teeth 28 or held against the bias of the first and second spring 52 and 54 such that the fitting engageable wrench head 26 (interchangeable wrench head 82) can freely rotate in the fitting engaging region 14.

As shown in FIGS. 6, 7*a/b* and 8*a/b*, the rotatable pawl disengager 56 is shaped to have at least two directrices. For example, in some embodiments, not shown, the pawl disengager 56 may have a square or triangle perimeter shape so that when it is rotated, the directrices may communicate with the first pawl 30 and the second pawl 38 so as to effect movement between a biased position such that they can interact with the spaced-apart teeth 28 and a position held against the bias of springs 52 and 54 such that the fitting engageable wrench head 26 (interchangeable wrench head 82) can freely rotate in the fitting engaging region 14. As shown in the figures of the instant disclosure, in preferred embodiments, the rotatable pawl disengager 56 has an elliptical perimeter shape with a first directrix 62 and second directrix 64.

The first directrix 62 is complimentarily shaped to communicate and interact with a first pawl disengager effector region 36 located on the first pawl 30 between the tooth-engaging hooking distal end region 32 and the first pawl proximal end region 34. As shown in the figures, first pawl disengager effector region 36 may be provided as substantially concave depression for reversibly communicating with the first directrix 62 such that when, for example, the rotatable pawl disengager lever 66 is pivoted to effect movement of the rotatable pawl disengager 56 from the first pawl disengager orientation 58 (FIG. 7*b*) to the second pawl disengager orientation 60 (FIG. 7*a*), the first directrix 62 interacts with the first pawl disengager effector region 36 and the first pawl is moved in the first pawl receiving channel 42 against the bias of spring 52 such that the tooth-engaging hooking distal end region 32 cannot engage with the space-apart teeth 28. In order to have the tooth-engaging hooking distal end region 32 engageable with the spaced-apart teeth 28, the rotatable pawl disengager lever 66 pivot is reversed to effect rotation of the rotatable pawl disengager 56 from the second pawl disengager orientation 60 to the first pawl disengager orientation 58 to the (FIG. 7*b*)

where the tooth-engaging hooking distal end region 32 can engageably ratchet with the spaced-apart teeth 28 under the bias of spring 52 such that the first pawl 30 can linearly slide in the first pawl receiving channel 42 as the fitting engageable wrench head 26 (interchangeable wrench head 82) is advanced relative the handle portion 12 in the fitting engaging region 14.

Turning now to the interaction of the second directrix 64 and the second pawl proximal end region 48, the second pawl 38 has an angled second pawl disengager effector region 46 located near, and preferably at the end of the second pawl proximal end region 48, as shown in FIGS. 7*a/b* and 8*a/b*, for example. The second directrix 64, as the rotatable pawl disengager 56 is rotated from the first pawl disengager orientation 58 to the second pawl disengager orientation 60 (FIGS. 7*a* to 7*b*), slides up the angled proximal surface of the angled second pawl disengager effector region 46 and effects movement of the second pawl 38 in the second pawl receiving channel 44 against the bias of spring 54 such that the tooth-abutting hooking distal end region 40 is moved outward toward the external peripheral area 76*a* where the tooth-abutting hooking distal end region 40 cannot engage with the spaced-part teeth 28, as shown in FIG. 7*a*. Like the description above with respect to the first directrix 62 and the first pawl disengager effector region 36, as the rotatable pawl disengager lever 66 pivot is reversed to effect rotation of the rotatable pawl disengager 56 from the second pawl disengager orientation 60 to the first pawl disengager orientation 58 to the (FIG. 7*b*), the tooth-abutting distal end region 40 can engageably ratchet with the spaced-apart teeth 28 under the resilient bias of spring 54 such that the second pawl 38 can linearly slide in the second pawl receiving channel 44 as the fitting engageable wrench head 26 (interchangeable wrench head 82) is advanced relative the handle portion 12 in the fitting engaging region 14.

Although independently described above for simplicity, when rotation of the rotatable pawl disengager 36 is effected from the first pawl disengager orientation 58 to the second pawl disengager orientation 60, the first directrix 62 and the first pawl disengager region 36, as well as the second directrix 64 and the angled second pawl disengager effector region 46 simultaneously communicate such that the first and second pawls 30 and 38 are linearly slid such that the fitting engageable wrench head 26 (interchangeable wrench head 82) can freely rotate in the fitting engaging region 14. When the rotation of the rotatable pawl disengager 36 is reversed from the second pawl disengager orientation 60 to the first pawl disengager orientation 58, the first directrix 62 and the first pawl disengager region 36, as well as the second directrix 64 and the angled second pawl disengager effector region 46 are no longer in communication and the first and second springs 52 and 54 respectively bias the first and second pawls 30 and 38 such that the tooth-hooking distal end region 32 and the tooth-abutting distal end region 40 can ratchet against the spaced-apart teeth 28, as shown in FIGS. 7*b*, and 8*a/b*.

Figure 9:
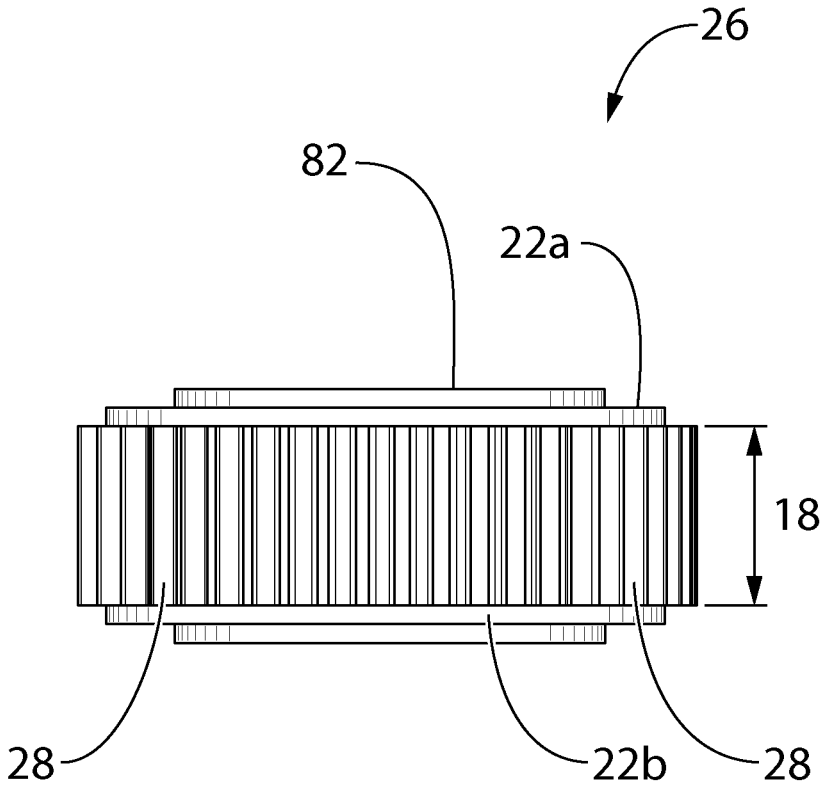
FIG. 9 is a side view of an exemplary fitting engageable interchangeable wrench head.

In further and complementary aspect of the instant disclosure, there is provided a plurality of interchangeable wrench heads 82, as noted above. FIG. 9, for example, is a side view of exemplary interchangeable wrench head 82 for use with interchangeable wrench head ratchet assembly 10 as described herein. The interchangeable wrench head 82, generally the fitting engageable wrench head 26, is substantially cylindrically shaped with the spaced-apart teeth 28 being aligned about the periphery of the cogged head 18. As noted above, head arcuate mating features 22*a* and 22*b* mate with the wrench body arcuate mating feature 20*a* and the cover arcuate mating feature 20*b* for guiding the interchangeable wrench head 82 in the fitting engaging region 14 of the wrench body 16. In some embodiments the head arcuate mating features 22*a* and 22*b* may be specifically fashioned to only correspondingly and operably mate with one of the wrench body arcuate mating features 20*a* or the cover arcuate mating feature 20*b*. In other embodiments, the head arcuate mating features 22*a* and 22*b* may be fashioned to correspondingly and operably mate with either one of the wrench body arcuate mating features 20*a* or the cover arcuate mating feature 20*b*, and, thus be reversible, or in other words, installable in either an upwards facing or downwards facing orientation relative the pawls and the wrench body 16. Furthermore, in some embodiments, such as those shown in the figures of the instant disclosure, the wrench body arcuate mating feature 20*a* and the cover arcuate mating feature 20*b* may be provided as arcuate channels and the head arcuate mating features 22*a* and 22*b* may be provided as arcuate ridges. However, in certain application, it may be desirable and it is contemplated to have the arcuate channels and arcuate ridges reversed (not shown) or provided in operably mateable combinations thereof. Also shown in FIG. 9 is the plurality of uniformly spaced-apart teeth 28, about the periphery of the cogged head 18, the interaction of which with the first and second pawls 30 and 38 is described in detail above.

Figure 10H:
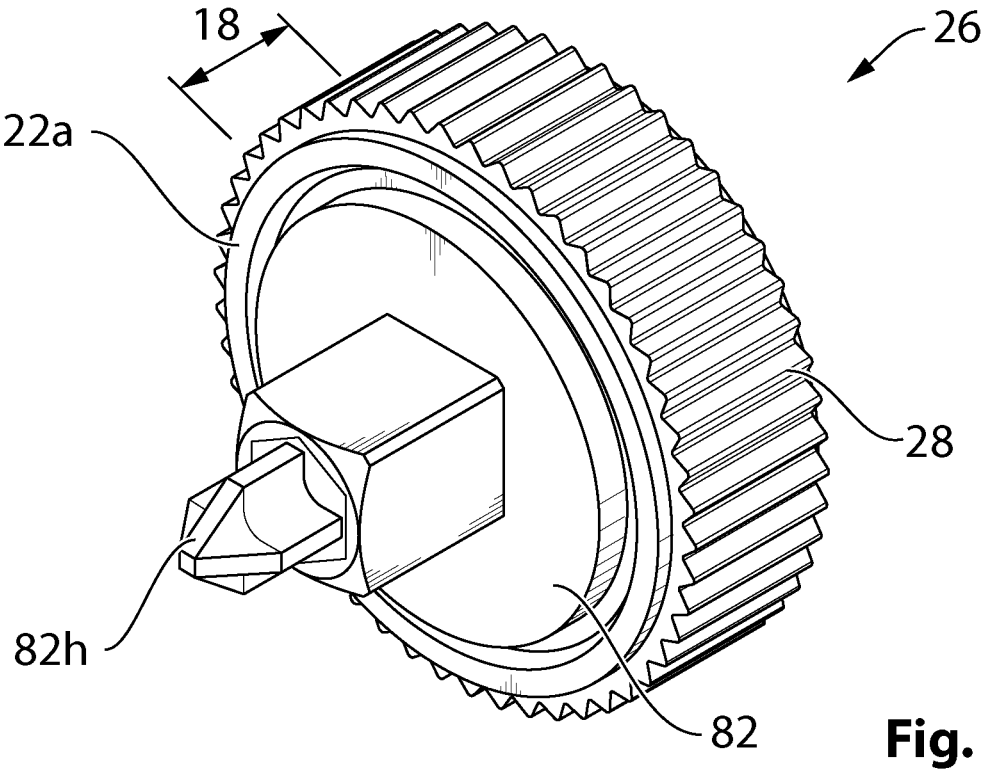
Figure 10I:
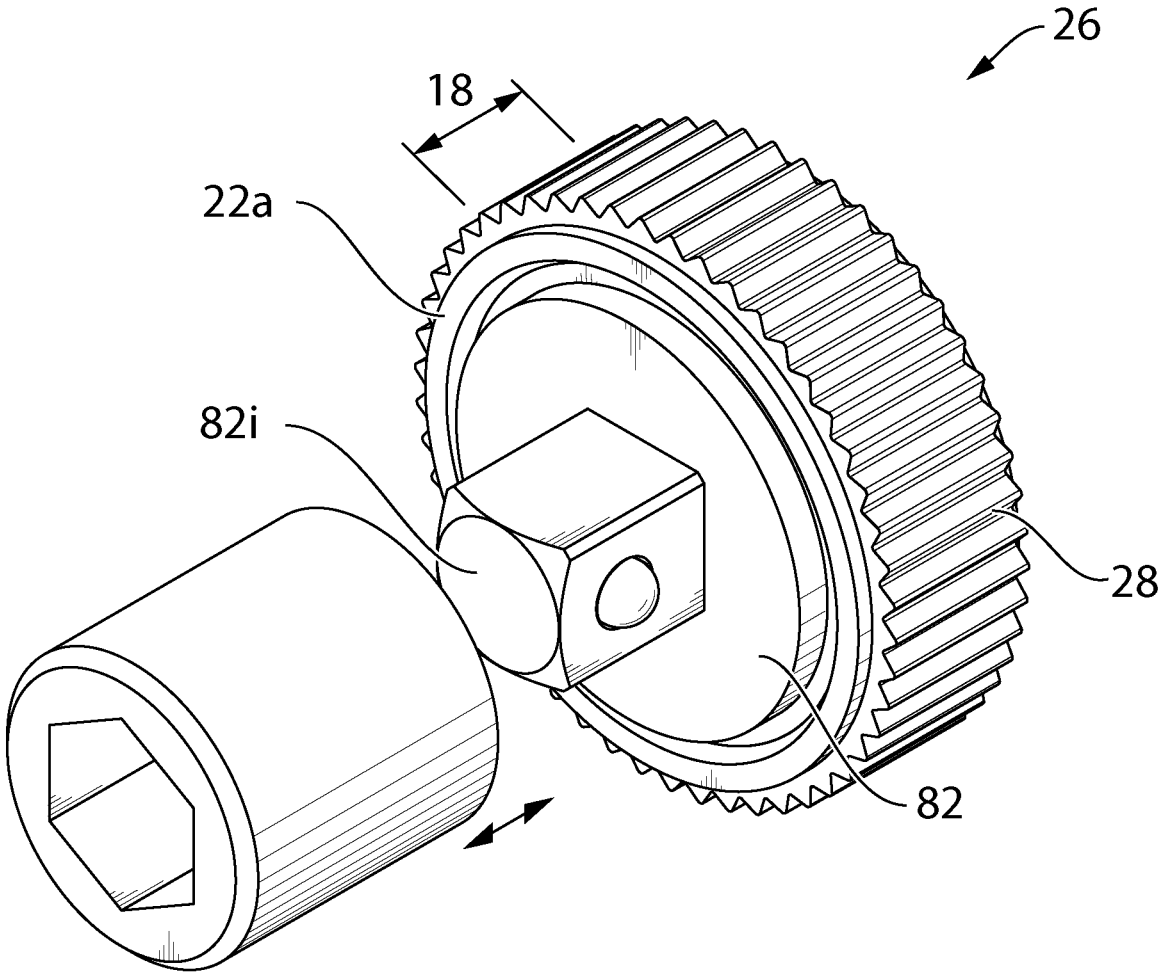

With specific reference to FIGS. 10*a* to 10*i* a variety of interchangeable wrench heads 82 (fitting engageable wrench heads 26) are shown. It is contemplated that various sizes of the interchangeable wrench heads 82 (fitting engageable wrench heads 26) can be provided to form a kit such that the interchangeable wrench head ratchet assembly 10 can be used to rotate a variety of differently dimensioned rotatable fittings similar to that known in the art for standard socket and wrench kits. Furthermore, such interchangeable wrench heads 82 (fitting engageable wrench heads 26) may also be provided separately for use with interchangeable wrench head ratchet assembly 10. As shown, for exemplary purposes only and not to be limited to the specific types and geometries of the interchangeable wrench heads 82 (fitting engageable wrench heads 26) illustrated, an exemplary line wrench sprocket head 82*a* (FIG. 10*a*), an exemplary line wrench socket head 82*b* (FIG. 10*b*), an exemplary open-sided sprocket wrench head 82*c* (FIG. 82*c*), an exemplary open-sided socket wrench head 82*d* (FIG. 10*d*), an exemplary box-ended sprocket wrench head 82*e* (FIG. 10*e*), an exemplary box-ended socket wrench head 82*f* (FIG. 10*f*), an exemplary pass-through socket wrench head 82*e* (FIG. 10*e*), an exemplary driver-bit receiving wrench head 82*e* (FIG. 10*e*), an exemplary screwdriver wrench head 82*h* (FIG. 10*h*) and/or an exemplary universal socket adapter wrench head 82*i* (FIG. 10*i*) are shown. FIG. 10*h*, for example, shows generically a Phillips head driver. However, other styles of screwdriver heads 82*h*, for example, Slot-head, Robertson and/or Torque-bit driver heads may be provided. Such wrench heads may be provided as non-removable fitting engageable wrench heads 26, for example, permanently rotatably installed in a ratchet assembly 10 or as an interchangeable wrench head 82 reversibly installable in ratchet assembly 10 having a wrench head retaining cover 70 system as described above.

In some embodiments where the interchangeable wrench head 82 or fitting engageable wrench head 26 is elongated, such as, for example, in case of the exemplary line wrench socket head 82*b* (FIG. 10*b*), the exemplary open-sided socket wrench head 82*d* (FIG. 10*d*), or the exemplary pass-through socket wrench head 82*e* (FIG. 10*e*) a waist portion 24 is formed in the external sidewalls. The waist portion 24, is located and formed immediately adjacent the cogged head 18 for receiving therein, when the interchangeable wrench head 82 or fitting engageable wrench head 26 is installed in the fitting engaging region 14, the interior peripheral region 76*b* of the wrench body 16. With the cogged head 18 being of a larger diameter than the waist portion 24, the cogged head 18 can be received in and maintained in operable communication with the wrench body 16 so as to operably couple the interchangeable wrench head 82 or fitting engageable wrench head 26 is and the wrench body 16.

Also, with respect to the embodiments described herein having interchangeable wrench heads 82 reversibly installable in ratchet assembly 10 having a wrench head retaining cover 70 system, a method for installing interchangeable wrench heads 82 is provided. In such a method, the interchangeable wrench head ratchet wrench 10 is provided. With the rotatable pawl disengager in the second pawl disengager orientation 60, the wrench body arcuate mating feature 20*a* is aligned with the head arcuate mating feature 22*a* of the one interchangeable wrench heads 82. However, as noted above, although not shown in the figures, one of skill in the art may recognize that an interchangeable wrench head 82 may be installed or removed without the pawl disengager 56 in the second pawl disengager orientation 60; that being in the first pawl disengager orientation 58. In such an action, the tooth-engaging hooking distal end region 32 and tooth-engaging abutting distal end region 40 of the first and second pawls 30 and 38 are interlaced between some of the correspondingly-aligned spaced-apart teeth 28 by a user rotating the interchangeable wrench head 82 in the fitting engaging end region 14 such that the wrench head 26 is installed therein and the respective arcuate mating features mated. The wrench head retaining cover 70 is then installed on the wrench body 16 as described above where, in some embodiments, the cover arcuate mating feature 20*b* is aligned with the head arcuate mating feature 22*b* and the interchangeable wrench head 82 is thus installed in the fitting engaging region 14 and guided along the arcuate mating feature in a rotatable fashion relative the wrench body 16. By pivoting a pawl disengager lever 66, in preferred embodiments, the elliptically-shaped rotatable pawl disengager 56 connected thereto and disposed in a wrench body 16 is thus rotated from a second pawl disengager orientation 60 to a first pawl disengager orientation 58 wherein the first directrix 62 of rotatable pawl disengager 56 communicates with the first pawl disengager effector region 36 and the second directrix 64 of the rotatable pawl disengager 56 communicates with the angled second pawl disengager effector region 46 to effect linear movement the first and second pawls 30 and 38 in the respective first and second pawl receiving channels 42 and 44 of the wrench body 16. Springs 52 and 54 then, respectively, resiliently bias the tooth-engaging hooking distal end region 32 and tooth-engaging abutting distal end region 40 with spaced-apart teeth 28 located about the periphery of the cogged head 18 of the fitting engageable interchangeable wrench head 82. With the tooth-engaging hooking distal end region 32 and tooth-engaging abutting distal end region 40 engaged with the spaced-apart teeth 28 under the reversible resilient bias of springs 52 and 54, the fitting engageable interchangeable wrench head 82 may ratchet to advance relative the wrench body 16 as the handle portion 12 is pivoted in the direction towards the first pawl 30 and the tooth-engaging hooking distal end region 32 and tooth-engaging abutting distal end region 40 may not ratchet with spaced-apart teeth 28 when the handle portion is moved in the direction towards the second pawl 38, thereby allowing a rotatable fitting to be rotated when engaged with the fitting engageable interchangeable wrench head 82. Accordingly, with the first and second pawls 30 and 38, in an operably communicating position with the spaced-apart teeth 28, the handle portion 12 (and thus the wrench body 16) is permitted to rotate in only in the direction toward the first pawl 30 relative to the fitting engageable interchangeable wrench head 82 and the fitting engageable interchangeable wrench head 82 is guided by the correspondingly mated head and wrench body arcuate mating features.

As also part of the fitting engageable interchangeable wrench head installation method, in order to remove a fitting engageable interchangeable wrench head 82 from the fitting engaging region 14, for example to install a different wrench head, the rotatable pawl disengager 56 is rotated from the first pawl disengager orientation 58 to the second pawl disengager orientation 60. As noted above, in some embodiments, the rotatable pawl disengager 56 may need to be rotated from the first pawl disengager orientation 58 to the second pawl disengager orientation 60 to permit removal of the interchangeable wrench head 82 from the fitting engaging region 14. However, in order to maintain the first and second pawls 30 and 38 in a position where the interchangeable wrench head 82 can freely rotate in the fitting engaging region 14, the first directrix 62 communicates with the first pawl disengager effector region 36 and the second directrix 64 with the angled second pawl disengager effector region 46 effect linear movement against resilient bias of springs 52 and 54 acting on the first and second pawls 30 and 38 in respective first and second pawl receiving channels 42 and 44 so as to disengage the tooth-engaging hooking distal end region 32 and tooth-engaging abutting distal end region 40 from the spaced-apart teeth 28. The fitting engageable interchangeable wrench head 82 is thus permitted to rotate in either direction guided by the correspondingly mated head and wrench body arcuate mating features. The wrench head retaining cover 70 reversibly coupled to the wrench body 16 is then removed, as described above, to access the fitting engageable interchangeable wrench head 82, which can then be removed.

It is to be understood that the above description is intended to be illustrative, and not restrictive. Many other embodiments will be apparent to those skilled in the art, upon reviewing the above description. The scope of the invention should, therefore, be determined with reference to the appended claims, along with the full scope of equivalents to which such claims are entitled.

Although the present invention has been described with reference to specific exemplary embodiments, it will be evident that various modifications and changes may be made to these embodiments without departing from the broader spirit and scope of the disclosed subject matter as defined by the appended claims.

What is claimed is:

1. A ratchet assembly comprising:

a handle portion; and an opposed fitting engaging region defining a wrench body, the wrench body including a first pawl in a first pawl receiving channel, a second pawl in a second pawl receiving channel, a pawl disengager and a body arcuate mating feature to receive in operable rotatable communication a head arcuate mating feature of a fitting engageable wrench head, the first and second pawl receiving channels defining a first axis and a second axis, respectively, each axis being at least substantially tangential to the body arcuate mating feature, the wrench body and the wrench head being rotatable relative to one another about an axis of rotation with the head arcuate mating feature and the body arcuate mating feature in communication;

the wrench head having a plurality of teeth located about the periphery thereof for engaging with a distal end region of at least one of the first pawl having a tooth engaging hooking distal end region and a proximal end movable in the first pawl receiving channel along the first axis, and the second pawl having a tooth engaging abutting distal end region and a proximal end movable in the second pawl receiving channel along the second axis, the pawl disengager cooperating with the first and second pawls to move the first and second pawls and movable to a tooth-engaged position in which the distal end regions of both first pawl and second pawl are positioned to engage the teeth of the wrench head and wherein both engagement of the teeth by one of the distal end regions of the first and second pawls and engagement of teeth by both distal end regions of the first and second pawls allows ratcheting rotation of the wrench head in only one direction relative to the wrench body and the ratcheting rotation causes the teeth to move one of the first pawl and the second pawl linearly along the respective axis, a tooth-disengaged position in which both distal end regions of the first and second pawls disengage with the teeth, and where movement of the pawl disengager between the tooth-engaged and tooth-disengaged position moves the first pawl linearly along the first axis and second pawl linearly along the second axis.

2. The assembly of claim 1, where the pawl disengager rotates between the tooth-engaged position and tooth-disengaged position.

3. The assembly of claim 1, where the pawl disengager includes a portion cooperating with the first and second pawls that is not a circular shape.

4. The assembly of claim 1, where the pawl disengager has an elliptical perimeter shape with first and second directrices;

the first pawl includes a corresponding concave depression for reversibly communicating with the first directrix, the second pawl reversibly communicates with the second directrix.

5. The assembly of claim 1, further comprising:

a first spring to bias the first pawl to the tooth-engaged position along the first axis; and a second spring to bias the second pawl to the tooth-engaged position along the second axis.

6. The assembly of claim 5, where the first spring communicates with the proximal end of the first pawl; and the second spring communicates with the distal end region of the second pawl.

7. The assembly of claim 1, where the pawl disengager includes a pawl lever that is rotatable to move the pawl disengager between the tooth-engaged and tooth-disengaged positions.

8. The assembly of claim 1, further comprising a cover plate for enclosing at least the first and second pawls and the pawl disengager in the wrench body.

9. The assembly of claim 1, wherein the wrench head is interchangeable with different interchangeable wrench heads.

10. The assembly of claim 1, where the pawl disengager communicates with the first pawl between the first pawl distal end region and a first pawl proximal end and communicates with second pawl near the second pawl proximal end.

11. A wrench comprising:

a handle portion; and an opposed fitting engaging region defining a wrench body, a fitting engagable wrench head having a plurality of peripheral teeth received in in the opposed fitting engaging region, the wrench body including a first pawl in a first pawl receiving channel, a second pawl in a second pawl receiving channel, and a pawl disengager, the first pawl having a distal end and a proximal end defining a first axis within the first pawl receiving channel, the second pawl having a distal end and a proximal end defining a second axis within the second pawl receiving channel, the pawl disengager cooperating with the first pawl and second pawl to move the first pawl and second pawl along the respective axes within the first and second pawl receiving channels to a tooth-engaged position in which the distal end regions of both the first pawl and the second pawl are positioned to engage the teeth of the wrench head and wherein both engagement of the teeth by one of the distal end regions of the first and second pawls and engagement of teeth by both distal end regions of the first and second pawls allows ratcheting rotation of the wrench head in only one direction relative to the wrench body and the ratcheting rotation causes the teeth to move one of the first pawl and the second pawl linearly along the respective axis, and a tooth-disengaged position in which both distal ends of the first and second pawls disengage with the teeth, and where movement of the pawl disengager between the tooth-engaged and tooth-disengaged positions moves the first pawl linearly along the first axis and second pawl linearly along the second axis.

12. The wrench of claim 11, where the pawl disengager rotates between the tooth-engaged position and tooth-disengaged position.

13. The wrench of claim 11, where the pawl disengager has an elliptical perimeter shape with first and second directrices; the first pawl includes a corresponding concave depression for reversibly communicating with the first directrix, the second pawl reversibly communicates with the second directrix.

14. The wrench of claim 11, further comprising:

a first spring to bias the first pawl to the tooth-engaged position along the first axis; and a second spring to bias the second pawl to the tooth-engaged position along the second axis.

15. The wrench of claim 11, wherein the wrench head is one of a plurality of interchangeable wrench heads.

16. The wrench of claim 11, where the application of force to the handle portion with the pawl disengager in the tooth-engaged position rotates the wrench body and the wrench head.

17. The wrench of claim 16, where the application of force to the handle portion with the pawl disengager in the tooth-disengaged position rotates the wrench body relative to the wrench head.

18. The wrench of claim 11, further comprising a cover to retain the wrench head in the wrench body.

19. A method of using a wrench comprising:

providing a wrench including a wrench body including a handle portion and an opposed fitting engaging region, the opposed fitting region including a first pawl having a distal end and a proximal end in a first pawl receiving channel defining a first axis, a second pawl having a distal end and a proximal end in a second pawl receiving channel defining a second axis, a pawl disengager to cooperate with the first and second pawl and movable to a tooth-engaged position in which the distal end regions of both first pawl and second pawl are positioned to engage teeth of an installed wrench head and wherein both engagement of the teeth by one of the distal end regions of the first and second pawls and engagement of teeth by both distal end regions of the first and second pawls allows ratcheting rotation of the wrench head in only one direction relative to the wrench body and the ratcheting rotation causes the teeth to move one of the first pawl and the second pawl linearly along the respective axis, and a tooth-disengaged position in which both distal ends of the first and second pawls disengage with the teeth, and where movement of the pawl disengager between the tooth-engaged and tooth-disengaged positions moves the first pawl linearly along the first axis and second pawl linearly along the second axis, installing the wrench head in the opposed fitting engaging region, the teeth of the wrench head including a plurality of teeth located about the periphery thereof for engaging with the distal end of at least one of the first pawl and the second pawl, engaging a fitting with the wrench head; and applying force to the fitting via the wrench head and wrench body.

20. The method of claim 19, further comprising installing a removable cover to enclose the first pawl, the second pawl, the pawl disengager, and the wrench head.

* * * * *